US008592124B2

(12) United States Patent
Oya et al.

(10) Patent No.: US 8,592,124 B2
(45) Date of Patent: Nov. 26, 2013

(54) TONER FOR DEVELOPMENT OF ELECTROSTATIC IMAGE, ELECTROSTATIC IMAGE DEVELOPER, TONER CARTRIDGE, PROCESS CARTRIDGE, AND IMAGE FORMING APPARATUS

(75) Inventors: Yasuhiro Oya, Kanagawa (JP); Atsuhiko Eguchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1196 days.

(21) Appl. No.: 12/168,571

(22) Filed: Jul. 7, 2008

(65) Prior Publication Data

US 2009/0142110 A1 Jun. 4, 2009

(30) Foreign Application Priority Data

Dec. 3, 2007 (JP) ..... 2007-312340

(51) Int. Cl.
*G03G 9/08* (2006.01)
*G03G 9/087* (2006.01)

(52) U.S. Cl.
USPC ..... 430/111.4; 430/109.4

(58) Field of Classification Search
USPC ..... 430/111.4, 109.4
See application file for complete search history.

(56) References Cited

U.S. PATENT DOCUMENTS

| | | | | |
|---|---|---|---|---|
| 3,853,778 | A | 12/1974 | Buckley et al. | |
| 5,346,797 | A | 9/1994 | Kmiecik-Lawrynowicz et al. | |
| 6,137,977 | A * | 10/2000 | Okado et al. | 399/252 |
| 2002/0048713 | A1* | 4/2002 | Komoto et al. | 430/124 |
| 2004/0114960 | A1* | 6/2004 | Kunou et al. | 399/109 |
| 2004/0229150 | A1* | 11/2004 | Miyazaki et al. | 430/111.4 |
| 2005/0175919 | A1* | 8/2005 | Hayashi et al. | 430/108.4 |
| 2005/0208405 | A1* | 9/2005 | Ayaki et al. | 430/108.4 |
| 2006/0204880 | A1 | 9/2006 | Mizutani et al. | |
| 2007/0092820 | A1* | 4/2007 | Bensing et al. | 430/108.4 |
| 2007/0092822 | A1 | 4/2007 | Matsumura et al. | |

FOREIGN PATENT DOCUMENTS

| | | |
|---|---|---|
| JP | B2 56-13943 | 4/1981 |
| JP | A 63-282752 | 11/1988 |
| JP | A 6-250439 | 9/1994 |
| JP | A 11-38677 | 2/1999 |

(Continued)

OTHER PUBLICATIONS

Machine Translation of JP2003-050478.*

(Continued)

*Primary Examiner* — Jonathan Jelsma
(74) *Attorney, Agent, or Firm* — Oliff & Berridge, PLC

(57) ABSTRACT

A toner having: a peak temperature before fixation T1*a* of about 40° C. or more; and a peak temperature after fixation T1*b* that is lower than T1*a* by from about 10° C. to about 35° C.: T1*a* being a peak temperature of an endothermic peak occurring at the lowest temperature in a range of from 0° C. to 100° C. and obtained at a first warming-up step of a differential scanning calorimetry measurement that uses a toner before fixation as a sample; T1*b* being a peak temperature of an endothermic peak occurring at the lowest temperature within a range of from 0° C. to 100° C. and obtained at a first warming-up step of a differential scanning calorimetry measurement that uses a toner after fixation as a sample; and the toner after fixation being contained in a fixed image transferred from a transferring member and fixed on a recording medium, a maximum width of an image defect formed after conducting a folding test of the fixed image being 0.30 mm or less.

16 Claims, 3 Drawing Sheets

(56) References Cited

FOREIGN PATENT DOCUMENTS

| | | |
|---|---|---|
| JP | A 2000-35695 | 2/2000 |
| JP | A 2000-352841 | 12/2000 |
| JP | A 2003-25558 | 1/2003 |
| JP | A 2003-50478 | 2/2003 |
| JP | A 2004-206081 | 7/2004 |
| JP | A-2005-275146 | 10/2005 |
| JP | A-2006-215537 | 8/2006 |
| JP | A-2006-251564 | 9/2006 |
| JP | A-2007-114627 | 5/2007 |

OTHER PUBLICATIONS

Japanese Office Action issued in Japanese Patent Application No. 2007-312340, on Dec. 22, 2009.

* cited by examiner

TONER FOR DEVELOPMENT OF ELECTROSTATIC IMAGE, ELECTROSTATIC IMAGE DEVELOPER, TONER CARTRIDGE, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2007-312340 filed Dec. 3, 2007.

BACKGROUND

1. Technical Field

The invention relates to a toner for development of an electrostatic image, an electrostatic image developer, a toner cartridge, a process cartridge and an image forming apparatus.

2. Related Art

Methods of visualizing image information via an electrostatic image, such as an electrophotographic method, have been employed in various fields. In the electrophotographic method, an electrostatic image is formed on a photoreceptor through processes of charging and exposing to light, and is visualized by developing with a developer containing a toner, transferring and fixing.

The toner mentioned above is generally composed of toner matrix particles containing a binder resin, a colorant, a releasing agent, a charge control agent and the like, which are formed into particles by a kneading pulverizing method, a suspension polymerization method, an emulsion aggregation method, a dissolution suspension method, or the like; and an auxiliary agent that is added to the surface of the toner matrix particles, such as inorganic metal oxide particles of silica, titania, alumina or the like, and inorganic/organic particles that are optionally added to aid cleaning capacity or polishing capacity of the photoreceptor. Further, with both black and white printing and full color printing, a toner usable with oil-less fixing devices in which oil is not supplied to a fixing roll, serving as a fixing member, has been widely used.

In the aforementioned electrophotographic process, various kinds of mechanical stresses are applied. Therefore, to stably maintain the functions of the toner, it is necessary to suppress exposure of a releasing agent to the surface of the toner and, further, it is necessary to enhance surface hardness and fixing ability of the toner itself in order to improve mechanical strength and maintain sufficient chargeability. Additionally, in response to the demand for high image quality, the size of the toner has been remarkably reduced in order to realize a highly precise image in an image formation process.

However, simply reducing the size of the toner without changes to conventional particle size or shape distribution results in toner particles having minute sizes or deformed shapes, which could cause problems such as contamination of a carrier or a photoreceptor with the toner, scattering of the toner, or attachment of the toner to a fixing roll rather than a recording medium. Therefore, it is difficult to achieve both of high image quality and high reliability. Consequently, there is a demand for a toner having both particles of reduced size and narrower particle size distribution or shape distribution.

Further, there has been a demand for a technique by which a toner may be fixed with less energy in order to reduce energy consumption of a copier or a printer, and therefore a toner for electrophotography that can be fixed at lower temperature has been strongly desired.

As a means for reducing the fixing temperature of the toner, a technique of lowering a glass transition temperature (Tg) of a resin for a toner is widely employed. However, if the glass transition temperature is too low, aggregation of toner powder (blocking) may easily occur or storability of the toner formed on a fixed image may be lost. Therefore, the glass transition temperature has to be about 50° C. at lowest, in practical use.

The use of polyester resin as a binder resin has been attempted due to its superior low-temperature fixability and heat-resistant storability, in place of styrene and acrylic resins that have been widely used as binder resins. However, there is a problem with polyester resins that dispersibility of a releasing agent (wax) in the polyester resin is poor and the mixture tends to pulverize at an interface of the binder resin and the releasing agent, thereby causing degradation of toner powder characteristics or charging characteristics due to the exposed releasing agent on the toner surface. Moreover, even in a wet method including aggregation and coalescence processes, there has been a problem that degradation of toner powder characteristics or charging characteristics is caused by the releasing agent that tends to be exposed on the toner surface, or detach from toner particles, at the time of coalescence process carried out with heat.

SUMMARY

According to an aspect of the invention, there is provided a toner having:

a peak temperature before fixation T1*a* of about 40° C. or more; and a peak temperature after fixation T1*b* that is lower than T1*a* by from about 10° C. to about 35° C.:

T1*a* being a peak temperature of an endothermic peak occurring at the lowest temperature in a range of from 0° C. to 100° C. and obtained at a first warming-up step of a differential scanning calorimetry measurement that uses a toner before fixation as a sample;

T1*b* being a peak temperature of an endothermic peak occurring at the lowest temperature within a range of from 0° C. to 100° C. and obtained at a first warming-up step of a differential scanning calorimetry measurement that uses a toner after fixation as a sample; and the toner after fixation being contained in a fixed image transferred from a transferring member and fixed on a recording medium, a maximum width of an image defect formed after conducting a folding test of the fixed image being 0.30 mm or less.

BRIEF DESCRIPTION OF THE DRAWINGS

Exemplary embodiments of the present invention will be described in detail based on the following figures, wherein.

DETAILED DESCRIPTION

Figure 1:
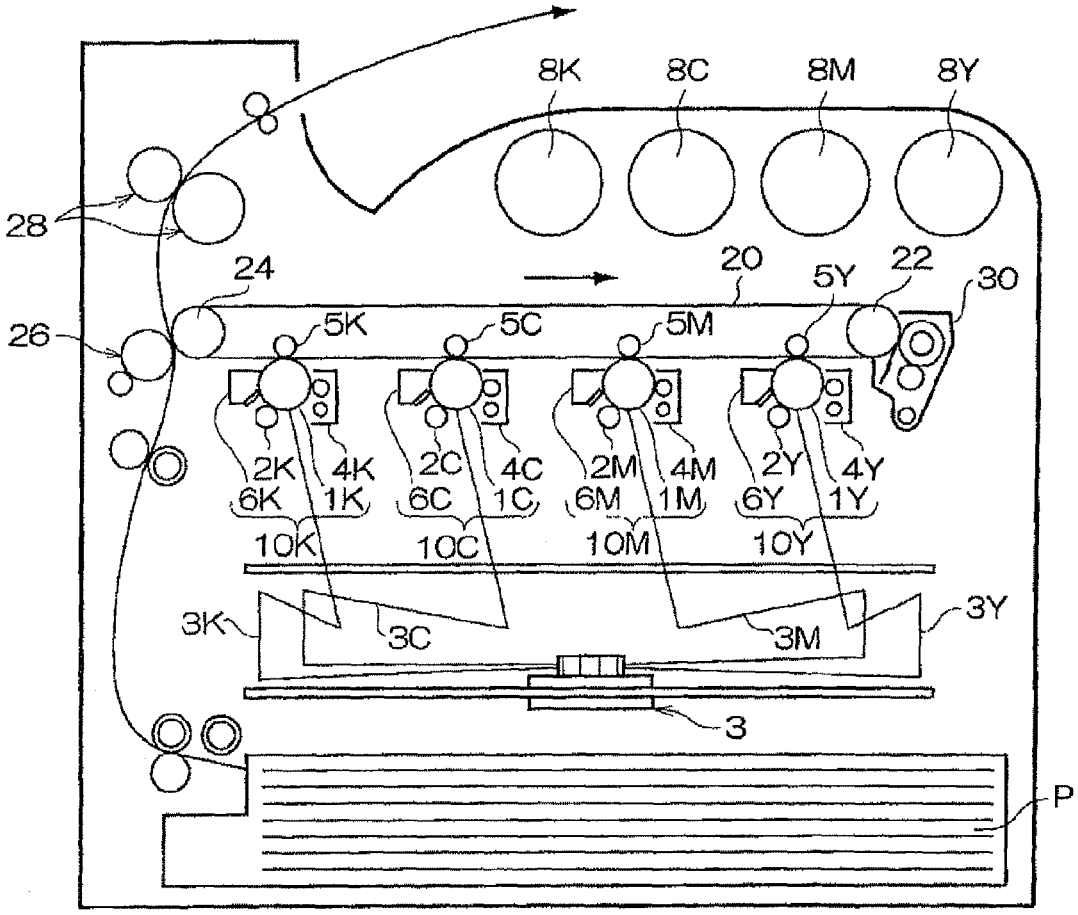
FIG. 1 is a schematic view of an exemplary embodiment of the image forming apparatus of the invention.

In the following, the invention will be described in detail with reference to exemplary embodiments.

<Toner for Electrostatic Image Development>

The toner for electrostatic image development (hereinafter, simply referred to as "toner") is a toner having a peak temperature before fixation T1*a* of 40° C. or more or about 40° C. or more and a peak temperature after fixation T1*b* that is lower than T1*a* by from about 10° C. or about 10° C. to 35° C. or about 35° C., T1*a* being a peak temperature of an endothermic peak occurring at the lowest temperature within a range of from 0° C. to 100° C. and obtained at a first warming-up step of a differential scanning calorimetry measurement that uses a toner before fixation as a sample; T1*b* being a peak temperature of an endothermic peak occurring at the lowest temperature within a range of from 0° C. to 100° C. and obtained at a first warming-up step of a differential scanning calorimetry measurement that uses a toner after fixation as a sample; and the toner after fixation being contained in a fixed image transferred from a transferring member and fixed on a recording medium, a maximum width of an image defect formed after conducting a folding test of the fixed image being 0.30 mm or less.

In an electrophotographic process, in order that a toner may stably maintain its properties even under various mechanical stresses, it is desirable to increase the surface hardness of the toner. In this case, since the hardness of the toner depends on the type of a binder resin contained in the toner as a main component, it is usually increased by increasing the strength of the binder resin, i.e., by increasing a glass transition temperature (Tg) or a melting temperature (Tm) of the binder resin. On the other hand, in order to secure a low-temperature fixability of the toner, it is necessary that the toner melts to a certain extent at fixation, and it is effectively achieved by lowering the Tg or Tm of the binder resin. Accordingly, the direction in maintaining the toner properties and the direction in ensuring favorable low-temperature fixability generally contradict each other.

Here, the aforementioned low-temperature fixation means that fixing is performed by heating a toner to a temperature of not more than about 135° C.

When fixing a toner by heating the toner, if changes in the structure of the binder resin is caused at a fixing process, which is a kind of heating process, the Tg or Tm of the binder resin after the heating process can be changed from those before the heating process. When the Tg or Tm of the binder resin after fixation is lowered compared with that of the binder resin before fixation, the binder resin (i.e., the toner) after fixation exhibits different viscoelasticity from that of the binder resin before fixation. It is thus considered to be an effective way of achieving both maintaining toner properties and obtaining low-temperature fixability of the toner.

As a means of measuring the Tg or Tm of the aforementioned toner, a differential scanning calorimetry (DSC) measurement is effectively employed. When the DSC measurement is carried out using a target toner as a measurement sample, it is considered that a thermal property behavior shown at a first warming-up step represents a thermal property of the toner that has not been subjected to a high temperature history at the time of passing through a fixing unit or the like (toner before fixation), which thus represents a thermal property of ordinary toner in a powdery state before solidifying. On the other hand, a thermal property behavior of a toner after fixation can be grasped by carrying out the DSC measurement using as a measurement sample a toner that has been favorably fixed by a fixing unit onto a recording medium such as paper.

As discussed above, in this exemplary embodiment, it is necessary that a toner has a peak temperature before fixation (T1*a*) of 40° C. or more or about 40° C. or more, where T1 is a peak temperature of an endothermic peak occurring at the lowest temperature within a range of from 0° C. to 100° C. obtained in a first warming-up step of a DSC measurement using the toner as a measurement sample.

For example, when a toner has the above peak temperature T1*a* of about 30° C., low-temperature fixation can be favorably performed. However, when printing is performed in a continuous manner for a long period of time at about 35° C., the temperature of a developer in a printing machine, the surface temperature of a photoreceptor or an intermediate transfer member, or the temperature of the toner collected from these units, which should be usually regulated within a range of from about 40° C. to about 45° C. by air-flow designing or system designing, may become around 50° C. In such cases, toners having the above peak temperature may exhibit inferior charge maintainability, anti-filming property or anti-blocking property. Therefore, it is necessary that the peak temperature T1*a* of a toner before fixation is at least 40° C.

The peak temperature T1*a* of a toner before fixation is preferably 50° C. or more or about 50° C. or more, and is more preferably 55° C. or more or about 55° C. or more.

In the following, the "endothermic peak occurring within a range of from 0 to 100 obtained in a first warning-up step in a DSC measurement" will be described.

Figure 3:
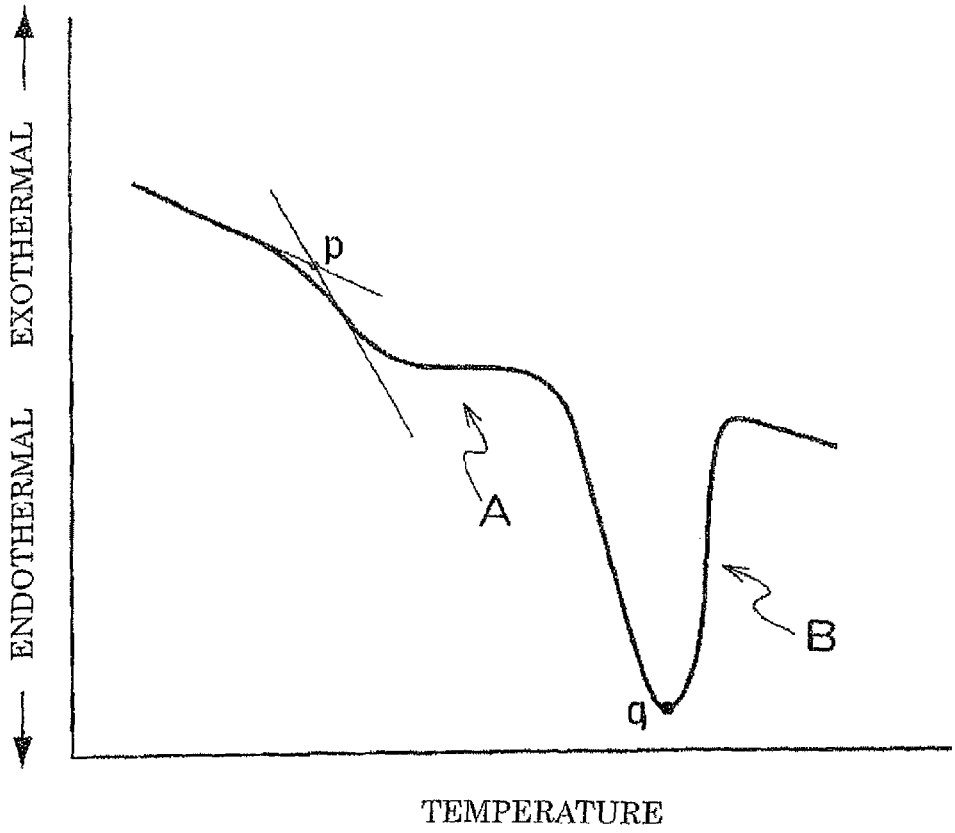
FIG. 3 is a schematic view of an exemplary embodiment of the endothermic/exothermic curve measured by differential scanning calorimetry.

When a toner includes a non-crystalline resin or a crystalline resin, as shown in FIG. 3, a stepwise endothermic peak A or a melting peak B are formed in a differential scanning calorimetry curve (DSC curve). The endothermic peak in this exemplary embodiment includes both the stepwise endothermic peak A and the melting peak B.

The endothermic peak A is defined as an intersection temperature p of a baseline and a rising slope of the endothermic peak, and the melting peak B is defined as the topmost point q of the endothermic peak. The same will apply to the endothermic peak or the like formed in a later-described second warming-up step.

However, even the peak temperature T1*a* of a toner before fixation is at the lowest level of 40° C. or about 40° C., there are limitations in achieving a low-temperature property and other characteristics at the same time. The inventors have found that a toner having a peak temperature T1*b* after fixation that is lower than the peak temperature before fixation T1*a* by from 10° C. or about 10° C. to 35° C. or about 35° C. achieves further improvements in low-temperature fixation, charge maintainability, anti-filming property and anti-blocking property at the same time.

Although the details are not clear, it is presumed that the distortion or mutual dissolution within a molecular structure of the toner is caused by heat or pressure applied from a fixing member upon fixation, and that affects the thermal characteristic behavior of the toner after fixation. It is therefore presumed that the peak temperature T1*b* becomes lower than the peak temperature T1*a* due to interaction of branches in a molecular structure, crosslinking of a metal, thermoplastic components or the like. In order to obtain favorable low-temperature fixability, it is preferable that the toner rapidly softens at the time of fixation, namely, that T1*b* decreases largely compared with T1*a*. However, designing a toner having a peak temperature T1 that drastically changes upon fixation is difficult in some cases, from a viewpoint of maintaining characteristics of the toner such as chargeability.

As a result of the above investigation, the inventors have found that it is necessary that a toner satisfies, in addition to a peak temperature T1*a* of 40° C. or more or about 40° C. or more, a peak temperature T1*b* that is lower than the T1*a* by from 10° C. or about 10° C. to 35° C. or about 35° C. When the difference between T1*a* and T1*b* is less than 10° C. or about 10° C., sufficient low-temperature fixability may not be obtained. When the difference between T1*a* and T1*b* is more than 35° C. or about 35° C., characteristics of a toner may not be ensured and, moreover, designing such a toner is difficult and performances of the toner before fixation may not be secured.

Further, it has also been found that the peak temperature T1*b* is preferably lower than T1*a* by from 20° C. or about 20° C. to 30° C. or about 30° C., and is preferably lower than T1*a* by from 25° C. or about 25° C. to 30° C. or about 30° C.

Additionally, in the toner of this exemplary embodiment, it is preferable that T1*b* is lower than a peak temperature T2*a* (° C.), which is a peak temperature of an endothermic peak occurring at the lowest temperature within a range of from 0° C. to 100° C. obtained in a second warming-up step of a DSC measurement using the aforementioned toner before fixation as a measurement sample, by from 1° C. or about 1° C. to 25° C. or about 25° C.

In the second warming-up step, the toner is completely melted for once to cancel the distortion in the molecule structure that originally exists inside the toner, and is then cooled. Since this step also promotes recrystallization, re-crosslinking, and removal of volatile components, it is presumed that the DSC curve obtained in this step represents thermal characteristics of a printed image after storage for a long period of time.

Accordingly, in order to achieve both the aforementioned favorable low-temperature fixability and the long-term storability of an image, the peak temperature T2*a* obtained in the second warming-up step is preferably higher than the peak temperature T1*b* of a toner after fixation.

When the difference between the peak temperatures T2*a* and T1*b* is less than 1° C. or about 1° C., sufficient fixation at low temperature may not be carried out when one desires to secure long-term storability of an image. When the above difference is more than 25° C. or about 25° C., the image after fixation may feel sticky, considering a glass transition temperature of an ordinary toner before fixation and the like. The difference between the peak temperatures T2*a* and T1*b* is more preferably in a range of from 5° C. or about 5° C. to 20° C. or about 20° C.

The aforementioned differential scanning calorimetry measurement in this exemplary embodiment of the invention is carried out in the following manner.

A differential scanning calorimeter (trade name: DSC-60A, manufactured by Shimadzu Corporation) is used for the measurement. In the measurement, a first warming-up step is conducted by elevating the temperature from room temperature to 150° C. at a rate of 10° C. per minute. Subsequently, the temperature is kept at 150° C. for 5 minutes, decreased to 0° C. at a rate of 10° C. per minute using a liquid nitrogen, and is then kept at 0° C. for 5 minutes. Thereafter, a second warming-up step is conducted by elevating the temperature again from 0° C. to 150° C. at a rate of 10° C. per minute. The DSC curves obtained in the first and second warming-up steps are analyzed in accordance with JIS (Japanese Industrial Standard) K-7121:87, and the peak temperatures T1 and T2 are obtained.

In this exemplary embodiment of the invention, the "toner after fixation" refers to a toner that has been fixed on a recording medium such as paper under such conditions that sufficient fixation can be carried out with no occurrence of offset. The fixed image specifically refers to an image, which has a favorable quality without image defects due to a poor releasing property, with an image defect having a maximum width of 0.30 mm or less (when observed with a scale loupe at a magnification of 10 times) that is formed by lightly folding the image inward, putting a weight of 860 grams thereon and pressing it with a roller having a diameter of 76 mm at a rate of about 150 mm/s to make a crease; and then spreading out the image again.

In this case, since a toner collected from an image formed on a paper medium or an OHP sheet does not show a precise endothermic behavior due to incorporation of components from the medium, this exemplary embodiment of the invention uses a toner obtained from the following process as the "toner after fixation" in the aforementioned DSC measurement.

First, the toner used for measurement is uniformly sprinkled onto paper (C2 paper, manufactured by Fuji Xerox Co., Ltd.) in the form of a 3 cm×3 cm square with an amount of 15 g/m$^2$. The toner may be sprinkled via ordinary development and transfer processes, or may be gently sprinkled onto the medium through a mesh having openings of about 20 μm in diameter. The fixing conditions at which the aforementioned favorable fixability can be obtained are determined using a press-and-heat type fixing device (fixing conditions are changeable). For example, when the temperature at which an image defect having a width of 0.30 mm or less according to the above method is formed at a fold line in the image is 150° C. or more, while performing fixation by changing the fixing temperature from 100° C. to 200° C. by an amount of 5° C., the fixing temperature is determined as 150° C.

Next, a PFA (tetrafluoroethylene-perfluoroalkylvinylether copolymer) sheet having a size of 5 cm square and a thickness of 50 μm (a thickness of from 20 μm to 70 μm may be used, whereas a sheet with a thickness of 100 μm or more is not suitable since heating from a fixing machine may be insufficient) is put onto paper (C2 paper, manufactured by Fuji Xerox Co., Ltd.) and at least one edge of the sheet outside the later-described toner image is fixed with a polyimide tape, Thereafter, the toner used for measurement is uniformly sprinkled onto the sheet in the form of a 3 cm×3 cm square at an amount of 5 g/m$^2$ (the toner may be sprinkled via ordinary development and transfer processes or may be gently sprinkled onto the medium through a mesh having openings of about 20 μm in diameter), and another PFA sheet is put thereon so as to cover the toner image (having at least one edge outside the toner image fixed with a polyimide tape). The resultant is allowed to pass through the fixing device with the fixing conditions as determined, and then only a toner component sandwiched between the PFA sheets are collected to prepare a measurement sample. The sampling process may be repeated until a sufficient amount of the toner for measurement is collected.

The toner after fixation that has been sampled is used for a DSC measurement within 24 hours from immediately after passing through the fixing device.

In the following, structure and characteristics of the toner in this exemplary embodiments will be described together with a production method thereof.

—Binder Resin—

In the toner of this exemplary embodiment, a binder resin used in the conventional toners can be used. Examples thereof include polymers or copolymers of the following monomers, or mixtures thereof: styrenes such as styrene, parachlorostyrene, α-methyl styrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl mechacrylate; vinylnitriles such as acrylonitrile and methacrylonitrile; vinylethers such as vinylmethylether and vinylisobutylether; vinylketones such as vinylmethylketone, vinylethylketone, vinylisopropenylketone; and polyolefins such as ethylene, propylene and butadiene.

Moreover, mixtures of the above vinyl polymers with epoxy resins, polyester resins, polyurethane resins, polyamide resins, cellulose resins, polyether resins, non-vinyl condensation resins or the like, or graft polymers obtained by polymerizing a vinyl monomer in the presence of such resins, may be used.

It is preferable that the binder resin is at least partly composed of a crystalline resin for further improving fixability. The crystalline resin is not particularly limited as long as it exhibits crystallinity, and specific examples thereof include crystalline polyester resins and crystalline vinyl resins. The crystalline polyester resins are preferable from the viewpoint of controlling the melting temperature of the binder resin. Among the crystalline polyester resins, aliphatic polyester resins having an appropriate melting temperature are particularly preferable.

In the invention, the "crystalline polyester resin" denotes a resin having a distinct endothermic peak (melting peak) in differential scanning calorimetry (DSC) rather than a stepwise change in the endothermic amount. A crystalline polyester resin in which other component(s) are copolymerized to the main chain thereof at an amount of no more than 50% by weight is also called a crystalline polyester resin.

The crystalline polyester resins that are favorably used in this exemplary embodiment and other polyester resins are synthesized from a polyvalent carboxylic acid component and a polyhydric alcohol component. The aforementioned polyester resin may be commercially obtained or may be synthesized appropriately.

Examples of the polyvalent carboxylic acid component include aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid; aromatic dicarboxylic acids such as dibasic acids of phthalic acid, isophthalic acid, terephthalic acid, naphthalene-2,6-dicarboxylic acid, malonic acid and mesaconic acid. Furthermore, anhydrides thereof and lower alkyl esters thereof may be also mentioned, but the invention is not limited thereto.

Examples of carboxylic acid having a valence of three or more include 1,2,4-benzenetricarboxylic acid, 1,2,5-benzenetricarboxylic acid, 1,2,4-naphthalenetricarboxylic acid, anhydrides thereof and lower alkyl esters thereof. They may be used alone or in combination of two or more kinds thereof.

The polyvalent carboxylic acid component preferably include a dicarboxylic acid component having a sulfonic acid group, in addition to the aforementioned aliphatic dicarboxylic acid or aromatic dicarboxylic acid. The dicarboxylic acid having a sulfonic acid group has such an effect of improving dispersion of a colorant such as a pigment. Further, in the presence of a sulfonic acid group, the whole crystalline polyester resin can be emulsified or suspended in water without using a surfactant, as described later, in the process of producing particles.

Examples of the dicarboxylic acid having a sulfonic acid group include, but are not limited to, sodium 2-sulfoterephthalate, sodium 5-sulfoisophthalate, and sodium sulfosuccinate. Lower alkyl esters and acid anhydrides of these dicarboxylic acids may also be mentioned. These carboxylic acid components having a valence of two or more and having a sulfonic acid group are contained by an amount of from 0 mol% to 20 mol%, preferably by an amount of 0.5 mol% to 10 mol %, with respect to the total carboxylic acid component constituting the polyester. When the above content is less than 0.5 mol%, temporal stability of emulsified particles may be deteriorate, while when the above content exceeds 10 mol%, crystallizability of the polyester resin may decrease. In addition, the process in which particles coalesce after aggregation may be adversely affected and regulating of toner diameters may be difficult.

Furthermore, in addition to the aforementioned aliphatic dicarboxylic acid or aromatic dicarboxylic acid, a dicarboxylic acid component having a double bond is preferably contained. The dicarboxylic acid having a double bond, having a capability of radically crosslinking at the double bond, can be used for preventing hot-offset at fixation. Examples of such dicarboxylic acids include, but are not limited to, maleic acid, fumaric acid, 3-hexenedioic acid, 3-octenedioic acid, lower esters thereof, and acid anhydrides thereof. Among them, fumaric acid and maleic acid are preferable from a viewpoint of cost efficiency.

The polyhydric alcohol component is preferably an aliphatic diol, and is more preferably a straight aliphatic diol having carbon atoms in the main chain of 7 to 20. When the aliphatic diol is branched, crystallizability of the polyester resin may decrease and the melting temperature thereof may be lowered, and an anti-toner blocking property, image storability or low-temperature fixability may deteriorate. When the carbon number is less than 7, the melting temperature may be elevated and fixation at low temperature may become difficult, when polycondensed with an aromatic dicarboxylic acid. On the other hand, when the carbon number exceeds 20, it may be difficult to obtain such materials at a practical level. The aforementioned carbon number is more preferably 7 to 14.

Specific examples of the aliphatic diol suitably used for synthesizing the crystalline polyester in this exemplary embodiment include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosandecanediol. In view of the availability, 1,8-octanediol, 1,9-nonanediol and 1,10-decanediol are preferable.

Examples of the alcohols having a valence of three or more include glycerol, trimethylol ethane, trimethylol propane, and pentaerythritol. These may be used alone, or two or more kinds may be used in combination.

The polyhydric alcohol component preferably contains the aforementioned aliphatic diol component at an amount of 80 mol % or more, more preferably 90 mol % or more. When the content of the aliphatic diol component is less than 80 mol %, crystallizability of the polyester resin may decrease. As necessary, for the purpose of adjusting the acid value or the hydroxyl group value, a monovalent acid such as acetic acid or benzoic acid, and a monovalent alcohol such as cyclohexanol or benzyl alcohol, may also be used.

The crystalline polyester resin can be prepared by conventional polyester polymerization methods of reacting an acid component with an alcohol component, without particularly limited. Examples of the methods include a direct polycondensation method and a transesterification method, which can be selected depending on the monomer type.

Preparation of the Crystalline Polyester Resin can be Performed at a Polymerization temperature of from 180° C. to 230° C., evacuating inside of the reaction system if necessary, by bringing the monomers into reaction while removing water or alcohol which are generated upon condensation. When the monomers do not dissolve or mutually dissolve under the reaction temperature, a solvent having a high boiling temperature may be added as a solubilizer. A polycondensation reaction is performed while distilling off the solubilizer. When a monomer having a poor compatibility is present in the copolymerization reaction, the monomer having a poor compatibility may be condensed with an acid or alcohol to be polycondensed, prior to the polycondensation with a main component.

Examples of a catalyst that can be used in preparation of the crystalline polyester resin include alkali metal compounds such as sodium and lithium; alkaline earth metal compounds such as magnesium and calcium; metal compounds such as zinc, manganese, antimony, titanium, tin, zirconium and germanium; phosphite compounds, phosphate compounds and amine compounds.

Specific examples thereof include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-t-butylphenyl)phosphite, ethyltriphenylphosphonium bromide, triethylamine and triphenylamine.

Examples of the crystalline vinyl-based resin include vinyl-based resins using (meth)acrylic acid ester of a long-chain alkyl or alkenyl group, such as amyl (meth)acrylate, hexyl (meth)acrylate, heptyl (meth)acrylate, octyl (meth) acrylate, nonyl (meth)acrylate, decyl (meth)acrylate, undecyl (meth)acrylate, tridecyl (meth)acrylate, myristyl (meth)acrylate, cetyl (meth)acrylate, stearyl (meth)acrylate, oleyl (meth)acrylate, and behenyl (meth)acrylate. In the present specification, the term "(meth)acryl" means both of "acryl" and "methacryl".

The melting temperature of the crystalline resin in this exemplary embodiment is preferably from 50° C. or about 50° C. to 100° C. or about 100° C., and is more preferably from 60° C. or about 60° C. to 80° C. or about 80° C. When the melting temperature is lower than 50° C. or about 50° C., storability of a toner or a toner image after fixation may have a problem, while when the melting temperature is higher than 100° C. or about 100° C., low-temperature fixation may not be performed to a sufficient degree, as compared with the conventional toners.

When the toner in this exemplary embodiment includes a crystalline resin, the melting temperature of the crystalline resin in the toner can be observed as a melting peak at a first warning-up step of the aforementioned DSC measurement.

In the following, the non-crystalline resin will be described in detail. The non-crystalline polyester resin used in this exemplary embodiment is obtained by polycondensation of mainly a polyvalent carboxylic acid and a polyhydric alcohol.

When the non-crystalline polyester resin is used in an emulsion-aggregation method, a resin particle dispersion can be readily prepared by adjusting an acid value of the resin or by using an ionic surfactant in the emulsion-dispersion process.

Examples of the polyvalent carboxylic acid in the non-crystalline polyester resin include aromatic carboxylic acids such as terephthalic acid, isophthalic acid, phthalic anhydride, trimellitic anhydride, pyromellitic acid and naphthalenedicarboxylic acid; aliphatic carboxylic acids such as maleic anhydride, fumaric acid, succinic acid, alkenylsuccinic anhydride and adipic acid; and alicyclic carboxylic acids such as cyclohexanedicarboxylic acid. These polyvalent carboxylic acids can be used alone or in combination of two or more. Among these polyvalent carboxylic acids, aromatic carboxylic acids are preferably used, and it is also preferable to use a carboxylic acid having a valence of three or more (e.g., trimellitic acid or its anhydride) with the dicarboxylic acid for forming a crosslinked structure or a branched structure in order to secure favorable fixability.

Examples of the polyhydric alcohol in the non-crystalline polyester resin include aliphatic diols such as ethylene glycol, diethylene glycol, triethylene glycol, propylene glycol, butanediol, hexanediol, neopentyl glycol and glycerol; alicyclic diols such as cyclohexanediol, cyclohexanedimethanol and hydrogenated bisphenol A; and aromatic diols such as an ethylene oxide adduct of bisphenol A and a propylene oxide adduct of bisphenol A. These polyhydric alcohols can be used alone or in combination of two or more. Among these polyhydric alcohols, aromatic diols and alicyclic diols are preferable, and aromatic diols are more preferable. In order to secure further favorable fixability, a polyhydric alcohol having a valence of three or more (e.g., glycerol, trimethylolpropane or pentaerythritol) may be used with the diol for forming a crosslinked structure or a branched structure.

In order to adjust the acid value of the polyester resin, a monocarboxylic acid and/or a monoalcohol may be added to the polyester resin obtained by polycondensation of a polyvalent carboxylic acid and a polyhydric alcohol, thereby esterifying a hydroxyl group and/or a carboxyl group at a polymerization end. Examples of the monocarboxylic acid include acetic acid, acetic anhydride, benzoic acid, trichloroacetic acid, trifluoroacetic acid and propionic anhydride, and examples of the monoalcohol include methanol, ethanol, propanol, octanol, 2-ethylhexanol, trifluoroethanol, trichloroethanol, hexafluoroisopropanol and phenol.

The non-crystalline polyester resin can be prepared by a condensation reaction of a polyhydric alcohol and a polyvalent carboxylic acid according to ordinary methods. For example, the non-crystalline polyester resin can be prepared by placing a polyhydric alcohol, a polyvalent carboxylic acid and, if necessary, a catalyst into a reaction container equipped with a thermometer, a stirrer and a water trickle condenser, heating the container to 150° C. to 250° C. in the presence of an inert gas (e.g. nitrogen gas), and removing a low-molecular compound generated as a byproduct from the reaction system in a continuous manner. The reaction is stopped when the acid value reaches a predetermined value, and the resultant is cooled to obtain the reaction product.

Examples of the catalyst used in synthesizing the non-crystalline polyester resin include esterified catalysts of organic metals such as dibutyltin dilaurate and dibutyltin oxide, and metal alkoxides such as tetrabutyl titanate. The amount of the catalyst to be added is preferably from 0.01% to 1.00% by weight with respect to the total amount of the raw material.

The non-crystalline polyester resin in this exemplary embodiment preferably has a weight average molecular weight (Mw) of from 5,000 to 1,000,000, further preferably from 7,000 to 500,000. The number average molecular weight (Mn) is preferably from 2,000 to 10,000, and the molecular weight distribution (Mw/Mn) is preferably from 1.5 to 100, further preferably 2 to 60, based on the molecular weight of a tetrahydrofuran (THF) soluble matter measured by a gel permeation chromatography (GPC) method.

When the weight average molecular weight and/or the number average molecular weight are below the aforementioned ranges, although this is effective in terms of low-temperature fixability, hot-offset resistance may deteriorate, or storability of a toner may be affected by lowering of the glass transition temperature of the toner. On the other hand, when the weight average molecular weight and/or the number average molecular weight are greater than the aforementioned ranges, although a sufficient level of hot-offset resistance can be provided, low-temperature fixability may deteriorate, and image storability may be affected due to hindered exudation of the crystalline polyester phase in the toner. Therefore, by satisfying the aforementioned conditions, all of the low-temperature fixability, hot-offset resistance and document storability can be readily achieved.

The molecular weight of the resin mentioned above is calculated by measuring the molecular weight of a THF soluble matter with a THF solvent, using GPC•HLC-8120 (manufactured by Tosoh Corporation) and column•TSK gel super HM-M (15 cm) (manufactured by Tosoh Corporation), and using a molecular weight calibration curve produced from a monodisperse polystyrene standard sample.

The acid value of the polyester resin (the amount by mg of KOH necessary for neutralizing 1 g of a resin) is preferably from 1 mg KOH/g to 30 mg KOH/g on the grounds that the aforementioned molecular weight distribution is readily obtained, granulating property of toner particles in an emulsion dispersing method is readily maintained, and a favorable environmental stability of the obtained toner (stability in chargeability against changes in temperature or humidity) is easily maintained. The acid value of the polyester resin can be adjusted by controlling a carboxyl group at the end of the polyester, i.e. adjusting a blending ratio and a reaction rate of a polyvalent carboxylic acid and a polyhydric alcohol in the raw material. Alternatively, a polyester resin having a carboxyl group in the main chain can be obtained by using trimellitic anhydride as a polyvalent carboxylic acid component.

—Colorant—

The colorant used in the toner in this exemplary embodiment is not particularly limited and may be any known ones.

Examples of the colorants include carbon black such as furnace black, channel black, acetylene black and thermal black; inorganic pigments such as bengal, iron blue and titanium oxide; azo pigments such as fast yellow, disazo yellow, pyrazolone red, chelate red, brilliant carmine and para brown; phthalocyanine pigments such as cupper phthalocyanine and non-metal phthalocyanine; condensated polycyclic pigments such as flavanthrone yellow, dibromo anthrone orange, perylene red, quinacridone red and dioxaxine violet; and the like.

More specifically, chromium yellow, hansa yellow, benzidine yellow, threne yellow, quinoline yellow, permanent orange GTR, pyrazolone orange, balkan orange, watch young red, permanent red, Du Pont oil red, Lysol red, rhodamine B lake, lake red C, rose bengal, aniline blue, ultramarine blue, Calco Oil blue, methylene blue chloride, phthalocyanine blue, phthalocyanine green, malachite green oxalate, C. I. Pigment Red 48:1, C.I. Pigment Red 122, C. I. Pigment Red 57:1, C. I. Pigment Red 238, C.I. Pigment Yellow 12, C. I. Pigment Yellow 97, C. I. Pigment Yellow 17, C. I. Pigment Yellow 180, C. I. Pigment Yellow 74, C. I. Pigment Yellow 93, C. I. Pigment Blue 15:1, C.I. Pigment Blue 15:3, and the like can be mentioned. These may be used alone or in combination of two or more.

In the toner in this exemplary embodiment, the content of the colorant with respect to 100 parts by weight of the binder resin is preferably in the range of from 1 part by weight to 30 parts by weight and, as necessary, a surface-modified colorant or a pigment dispersant may be used. By appropriately selecting the colorant, toners of yellow, magenta, cyan, black or the like can be obtained.

—Other Ingredients—

The toner in this exemplary embodiment may contain a releasing agent.

The releasing agent is not particularly limited and may be selected from any known ones.

Examples of the releasing agent include, but are not limited thereto, natural waxes such as carnauba wax, rice wax and candelilla wax; synthetic or mineral/petroleum-based waxes such as low molecular-weight polypropylene, low molecular-weight polyethylene, Sasol wax, microcrystalline wax, Fisher-Tropsch wax, paraffin wax and montan wax; ester waxes such as fatty acid wax and montanic acid wax; and the like. These releasing agents may be used alone or in combination of two or more.

The melting temperature of the releasing agent is preferably 50° C. or more or about 50° C. or more, and is more preferably 60° C. or more or about 60° C. or more, from the viewpoint of storability. From the viewpoint of anti-offset property, it is preferably not more than 110° C. or about 110° C., and is more preferably not more than 100° C. or about 100° C.

The content of the releasing agent in the toner with respect to 100 parts by weight of the binder resin is preferably in the range of from 1 part by weight to 30 parts by weight, and is more preferably in the range of from 2 parts by weight to 20 parts by weight. When the content of the releasing agent is less than 1 part by weight, the effect of adding the releasing agent may not be exhibited. On the other hand, when the content of the releasing agent is greater than 30 parts by weight, chargeability may be adversely affected and, further, contamination of a carrier may be caused, since the toner having degraded mechanical strength tends to break by a stress applied in a development device. Additionally, when such a toner is used as a color toner, a domain of the toner may easily remain in the fixed image, thereby impairing transparency of an OHP film.

The toner in this exemplary embodiment may further include an internal additive, a charge controller, an inorganic powder (inorganic particles), an organic powder (organic particles) and the like, as necessary.

Examples of the internal additives include magnetic materials including metals such as ferrite, magnetite, reduced iron, cobalt, nickel and manganese, alloys, and compounds containing such metals.

Examples of the charge controller include quaternary ammonium salt compounds, nigrosin compounds, dyes composed of an aluminum, iron or chromium complex, triphenyl methane pigments, amino group-containing polymer compounds, and fluorine-containing polymer compounds.

The inorganic powder is added mainly for the purpose of controlling the viscosity of the toner, and examples thereof include all kinds of inorganic particles of silica, titania, calcium carbonate, magnesium carbonate, calcium phosphate and cerium oxide, which are usually externally added to the surface of the toner.

Further, for the purpose of improving powder fluidity or chargeability of the toner, inorganic particles or organic particles may be externally added to the surface of the toner in this exemplary embodiment.

Examples of the inorganic particles include those of silica, alumina, titania, metatitanate, barium titanate, magnesium titanate, calcium titanate, strontium titanate, zinc oxide, silica sand, clay, mica, wollastonite, diatomite, cerium chloride, bengal, chromium oxide, cerium oxide, antimony trioxide, magnesium oxide, zirconium oxide, silicon carbide and silicon nitride. Among these, particles of silica, titania and alumina are preferable, and those that have been subjected to hydrophobic treatment are particularly preferable.

The inorganic particles are used mainly for the purpose of improving fluidity of the toner. The average primary particle diameter of the inorganic particles is preferably in the range of from 1 nm or about 1 nm to 200 nm or about 200 nm, and the amount thereof with respect to 100 parts by weight of the toner is preferably in the range of from 0.01 part by weight to 20 parts by weight. Among these, inorganic particles whose average primary diameter is in the range of from 50 nm or about 50 nm to 200 nm or about 200 nm are favorably used also for the purpose of improving adaptability of the toner for cleaning or transferring.

The organic particles are generally used for the purpose of improving adaptability of the toner for cleaning or transferring. Specific examples thereof include particles of polystyrene, polymethyl methacrylate and polyvinylidene fluoride.

(Method of Producing Toner)

As the method of producing the toner in this exemplary embodiment as described above, a wet method in which toner matrix particles are produced an acidic or alkali aqueous medium is preferable. Examples of such methods include, but are not limited thereto, a kneading pulverizing method, an aggregation coalescence method, a suspension polymerization method, a dissolution polymerization method, a dissolution suspension granulation method, a dissolution suspension method, a dissolution emulsion aggregation method. Among these, the toner is preferably produced by the aggregation coalescence method.

In the aggregation coalescence method, disruption of an ion balance in the aggregation system can be suppressed and regulation of the aggregation speed can be facilitated. In the suspension polymerization method, inhibition of occurrence of polymerization can be suppressed and, in particular, regulation of particle size can be facilitated. In the dissolution suspension granulation method or the dissolution emulsion aggregation method, stabilization of particles in a granulation or emulsion step can be facilitated.

In the aggregation coalescence method, toner matrix particles are produced, for example, via a step of producing a dispersion of aggregated particles including: mixing a dispersion containing at least one binder resin particles, a dispersion containing a releasing agent and a dispersion containing a colorant; adding to the mixture at least one metal salt polymer containing polyaluminum chloride, poly aluminum sulfate or the like; forming aggregated particles at an acidic liquid state; and growing the aggregated particles at a temperature regulated to the range from room temperature to 50° C., and a step of conducting aggregation and coalescence including: adding to the aggregated particle-containing dispersion a dispersion containing at least one a binder resin and mixing; attaching a shell to the surface of the aggregated particles; stopping the growth of the aggregated particles by controlling the pH of the aggregated particle-containing dispersion to the range of from neutral to basic; and heating to cause coalescence of the aggregated particles.

In the aforementioned step of producing a dispersion of aggregated particles, the at least one metal salt polymer is preferably a polymer of a quaternary aluminum salt, a mixture of a polymer of a quaternary aluminum salt and a polymer of a tertiary quaternary aluminum salt, or a compound of a tertiary aluminum salt. Specific examples of the polymers include inorganic metal salts such as calcium nitrate, polymers of an inorganic metal salt such as polyaluminum chloride, or aluminum sulfate. In this exemplary embodiment, the polymer of the metal salt is preferably polyaluminuma chloride or aluminum sulfate.

The above polymer of metal salt or the like is preferably added to the dispersion of aggregated particles so that the content thereof is in the range of from 0.11% by weight to 1.25% by weight. The amount of residual aluminum polymers or the like contained in the toner can be regulated, as necessary, by adding a chelating agent or the like at the step of stopping aggregation.

In the above process of producing a dispersion of aggregated particles, when a colorant or a releasing agent is contained therein, at least one of a resin dispersion, a colorant dispersion, and a releasing agent dispersion is prepared in advance.

When a crystalline or non-crystalline polyester resin is used as a binder resin, a dispersion thereof is emulsified by a known phase-transition emulsification technique or by applying mechanical sharing force to the dispersion that has been heated to a temperature of no less than the melting temperature of the resin. In this step, the emulsion may be stabilized by adjusting the acid value of the resin, adding an ionic surfactant, or causing self-neutralization by means of a neutralizing amine.

When a resin to which emulsion polymerization can be performed, such as a styrene or acrylic resin, is used, the emulsion can be prepared by dispersing resin particles prepared by emulsion polymerization or the like in a solvent using an ionic surfactant.

The above resin dispersion is preferably treated in the conditions of a pH of from 12 to 13 and a temperature of from 90° C. to 100° C., more preferably at a temperature of 95° C. or more, for 6 to 8 hours, in a state that resin particles having the average primary particle diameter of from 50 nm to 300 nm are dispersed. Further, when a non-crystalline polyester resin is dissolved in a solvent to prepare an emulsion for a resin to form a core, a wax or a crystalline resin having a lower melting temperature than that of the non-crystalline polyester resin is preferably dissolved in the solvent together. By taking such steps, it is presumed that the molecular structure in the resin is softened, and branching of the molecular structure, metal cross-linking or interaction by a thermoplastic component or the like is readily facilitated, thereby achieving functions and effects of the toner in this exemplary embodiment.

The above colorant dispersion is preferably prepared by dispersing particles of a colorant of desired color, such as blue, red and yellow, using an ionic surfactant having an opposite polarity to that of the ionic surfactant used in the preparation of the resin dispersion.

The above releasing agent dispersion is prepared by adding and dispersing a releasing agent in water together with an ionic surfactant or a polymeric electrolyte, such as a polymeric acid and a polymeric base; heating the dispersion to a temperature of no less than the melting temperature of the releasing agent; and performing granulation by a machine that can apply strong shearing, such as a homogenizer and a pressure-discharging disperser.

Subsequently, a mixture of at least one of the aforementioned resin dispersion, colorant dispersion and releasing agent dispersion is prepared, and at least one of a polymer or a compound of a metal salt including polyaluminum chloride or aluminum sulfate is added thereto. The pH of the mixture of dispersion(s) is then adjusted to be acidic (preferable in the range of from pH 2.5 to pH 5), and agitated in order to form aggregated particles. Thereafter, the aggregated particles are grown to give a dispersion of aggregated particles having diameters that are approximately equal to that of the desired toner (core aggregated particles). In the formation of the aggregated particles, the temperature of the mixture of dispersion(s) is desirably lower than the endothermic peak temperature T1*a* of the toner as measured by differential scanning calorimetry (preferably from room temperature to 50° C.).

In the aforementioned attaching step, a resin dispersion of at least one kind of resin particles is added to the above dispersion of aggregated particles, and the resin particles are attached to the surface of the aggregated particles (core aggregated particles) to form a surface layer (shell layer) of a desired thickness, thereby obtaining aggregated particles having a core/shell structure (core/shell aggregated particles).

The particle diameter of the resin particles, colorant particles and releasing agent particles, which are used in the aforementioned process of preparing a dispersion of aggregated particles, is preferably no more than 1 μm and is more preferably in the range of from 20 nm to 300 nm, from the viewpoint of readily regulating the diameter and particle size distribution of the toner to desirable values.

In the process of preparing a dispersion of aggregated particles, amounts of the ionic surfactants (dispersants) having different polarities contained in the resin particle dispersion or colorant particle dispersion may be unbalanced in advance. For example, the dispersion may be ionically neutralized using an inorganic metal salt such as calcium sulfate or a polymer of inorganic metal salt such as polyaluminum chloride, and then heated to a temperature of no more than the glass transition temperature of the resin particles to form core aggregate particles.

The process of preparing a dispersion of aggregated particles or the attaching process may be conducted multiple times in several batches.

In the aforementioned coalescence step, growth of the aggregated particles is stopped by adjusting the pH of the dispersion of aggregated particles obtained in the attaching step (dispersion of core/shell aggregated particles) to the range of from neutral to basic (preferably in the range of from pH 7 to pH 8.5) and by controlling the amount of the aluminum polymer or compound remaining in the toner by adding a chelating agent, as necessary. Further, the dispersion is heated to a temperature of no less than the glass transition temperature of the binder resin contained in the obtained core/shell aggregated particles (if two or more resins are used, to a temperature of no less than the highest glass transition temperature), or heated to a temperature of no less than the melting temperature of the binder resin, thereby causing coalescence of the aggregated particles. The aggregated particles are then cooled to a temperature of preferably no more than 40° C. to obtain toner matrix particles.

The desired toner matrix particles are obtained via further steps of washing, solid-liquid separation, and drying. In the washing step, sufficient substitution washing with ion exchange water is preferably performed in view of chargeability. The solid-liquid separation is preferably carried out by suction filtering, pressure filtering, or the like, in view of productivity, although the applicable method is not limited thereto. The drying step is preferably carried out by freeze drying, flash-jet drying, fluidized drying, fluidized drying with vibration, or the like, in view of productivity, although the applicable method is not limited thereto.

In particular, by carrying out shelf drying in order to stabilizing the molecular structure of constituent components of the particles (preferably at a temperature of from 45° C. to 48° C. for 20 to 24 hours), in addition to the above drying step, functions and effects of the toner in this exemplary embodiment can be further achieved.

After the above steps, an external additive may be added to the toner matrix particles by mixing the external additive with the toner matrix particles and agitating, for example, by a Henschel mixer or a V blender.

Examples of the inorganic oxide particles that may be used as the external additive include particles of silica, alumina, titania, meta titanium oxide, barium titanate, calcium titanate, strontium titanate, zinc oxide, silica sand, clay, mica, wollastonite, diatomaceous earth, cerium chloride, bengal, chromium oxide, cerium oxide, antimony trioxide, magnesium oxide, zirconium oxide, silicon carbide, and silicon nitride, which materials do not readily melt or soften at a temperature of usual fixing process. Among these, particles of silica and titania are preferable, and particles having been subjected to a hydrophobic treatment are particularly preferable.

The average primary particle diameter of the inorganic oxide particles is preferably in the range of from 5 nm to 300 nm, and a combination of at least one small external additive having an average primary particle diameter of 30 μm or less and at least one large external additive having an average primary particle diameter of from 100 nm to 300 nm is more preferable. The small external additive serves to improve fluidity of the toner and the large external additive serves to suppress embedding of the toner external additive in a developer or at a cleaning and collection position, by its spacer effect. Therefore, degradation of fluidity of the toner can be suppressed and transfer property of the toner can be improved.

The amount of the small external additive having an average primary particle diameter of 30 nm or less with respect to 100 parts by weight of the toner is preferably in the range of from 0.5 parts by weight to 5 parts by weight, and the amount of the large external additive having an average primary particle diameter of from 100 nm to 300 nm with respect to 100 parts by weight of the toner is preferably in the range of from 0.5 parts by weight to 5 parts by weight. When the amount of either small or large external additive is less than 0.5 parts by weight, the aforementioned effect may not be sufficient, and when the amount of either small or large external additive is more than 5 parts by weight, defects in chargeability or filming to a photoreceptor or other members may occur.

In the following, characteristics of the toner in this exemplary embodiment will be explained.

The toner in this exemplary embodiment preferably has a volume average particles size of from 3 μm or about 3 μm to 8 μm or about 8 μm, more preferably from 3.5 μm or about 3.5 μm to 6.0 μm or about 6.0 μm. When the volume average particle diameter is in the above range, favorable image resolution can be obtained and occurrence of offset at fixation can be prevented when rough paper is used as a recording medium.

The volume average particle size distribution index (GSDv) is desirably from 1.15 to 1.30, and is more desirably from 1.15 to 1.25.

The above volume average particle diameter can be calculated as follows.

The volume average particle diameter is determined as D50v, which is a volume average particle diameter at an accumulation of 50% from the smaller side in a cumulative distribution based on divided particle size ranges (channels) obtained from a particle size distribution as measured by a Coulter Multisizer II (manufactured by Becman Coulter, Inc.). In the same manner, a volume average particle diameter D16v at an accumulation of 16% from the smaller side and a volume average particle diameter D84v at an accumulation of 84% from the smaller side are determined, and the GSDv is determined as the value of $(D84v/D16v)^{1/2}$.

The average circularity of the toner in this exemplary embodiment is preferably in the range of from 0.93 or about 0.93 to 1.00, and the amount of particles having a circularity of less than 0.85 is preferably 3% by number or less. When these indexes satisfy the above ranges, a toner having a round shape and a narrow shape distribution can be obtained. Therefore, the amount of the toner for forming an image of the same density can be reduced, which is effective in fixation and deformation or fixation due to heat from a fixing unit, Further, even though the toner is directed to low-temperature fixation, the rate of toner particles having irregularities on the surface thereof is small. Therefore, problems that the toner partly melts to adhere to a fixing roll rather than a recording medium such as paper, and the like, can be suppressed.

The above circularity can be determined as the value of (circle-equivalent periphery length)/(periphery length), i.e., (the periphery length of a circle having the same projected area as that of the particle image)/(the periphery length of the projected image of the particle). The toner to be measured is collected by suctioning and a flow having a significantly flat shape is formed. The static image of the particle is taken by applying flash light to the flow, and the obtained image is analyzed by a flow-type particle image analyzer (for example, FPIA-2100, manufactured by Sysmex Corporation).

The amount of charges of the toner in this exemplary embodiment is preferably in the range of from 20 μC/g to 65 μC/g, and is more preferably in the range of from 25 μC/g to 55 μC/g, in terms of absolute value. When the amount of charges of the toner is less than 20 μC/g, smudges in background (fogging) may be caused, and when the amount of charges of the toner is more than 65 μC/g, image density may easily decrease.

<Electrostatic Image Developer>

In the following, the electrostatic image developer of the invention will be explained with reference to an exemplary embodiment thereof.

The electrostatic image developer of this exemplary embodiment may be a one-component developer employing the toner of the aforementioned exemplary embodiment, or may be a two-component developer employing the toner and a carrier.

The carrier used for the above two-component developer is not particularly limited, and may be selected from any known carriers. For example, a resin-coated carrier having a resin coating on the surface of the core can be mentioned. A resin-dispersed carrier in which a conductive material or the like is dispersed in a matrix resin may also be used.

Examples of the resin used for a coating or a matrix of the carrier include, but are not limited thereto, polyethylene, polypropylene, polystyrene, polyvinyl acetate, polyvinyl alcohol, polyvinyl butyral, polyvinyl chloride, polyvinyl ether, polyvinyl ketone, vinyl chloride/vinyl acetate copolymer, styrene/acrylic acid copolymer, straight silicone resins composed of organosiloxane linkages or modified products thereof, fluorocarbon resins, polyester, polycarbonate, phenol resins, epoxy resins, and the like.

Examples of the conductive material include, but are not limited thereto, metals such as gold, silver and cupper, titanium oxide, zinc oxide, barium sulfate, aluminum borate, potassium titanate, tin oxide, carbon black, and the like.

Examples of the core material for the carrier include magnetic metals such as iron, nickel and cobalt, magnetic oxides such as ferrite and magnetite, glass beads, and the like. When a magnetic brush method is employed, the carrier is preferably a magnetic material.

The volume average particle size of the carrier is preferably in the range of from 10 μm to 500 μm, and is more preferably in the range of from 30 μm to 100 μm.

The core material of the carrier may be coated with a resin by applying a solution containing the aforementioned resin and, as necessary, an additive dissolved in a suitable solvent. The solvent is not particularly limited and may be selected appropriately in view of the type of resin used or the coating characteristics thereof.

Specific examples of the method of coating with a resin include a dip coating method in which a core material of a carrier is dipped in a solution for forming a coating layer; a spray method in which a solution for forming a coating layer is sprayed onto a surface of a core material of a carrier; a fluid bed method in which a solution for forming a coating layer is sprayed onto a surface of a core material of a carrier which is suspended in flowing air; and a kneader coater method in which a core material for a carrier and a solution for forming a coating layer are mixed in a kneader coater, and a solvent is removed therefrom.

In the aforementioned two-component developer, the ratio by weight of the toner in this exemplary embodiment and the carrier (toner:carrier) is preferably in the range of from 1:100 to 30:100, and is more preferably in the range of from 3:100 to 20:100.

<Image Forming Apparatus>

In the following, the image forming apparatus according to an exemplary embodiment of the invention using the aforementioned toner will be explained.

The image forming apparatus in this exemplary embodiment includes an image holding member, a developing unit that develops an electrostatic latent image formed on the surface of the image holding member with a developer to form a toner image, a transfer unit that transfers the toner image formed on the image holding member onto a recording medium, and a fixing unit that fixes the toner image transferred onto the recording medium, wherein the electrostatic image developer according to the invention is used as the developer.

In the image forming apparatus, for example, the part containing the developing unit may have a cartridge structure (process cartridge) that can detachably attached to the main body of the image forming apparatus. The process cartridge includes at least a developer holding unit, and a process cartridge containing the electrostatic image developer is preferably used.

The following is an example of the image forming apparatus according to the invention. However, the example should not be construed as limiting the invention. Explanations of principal parts shown in the figure will be given, but explanations of other parts will be omitted.

FIG. 1 is a schematic constitutional view showing a full-color image forming apparatus in a 4-tandem system. The image forming apparatus shown in FIG. 1 is provided with first to fourth electrophotographic image forming units 10Y, 10M, 10C and 10K that output images of each color of yellow (Y), magenta (M), cyan (C) and black (K), based on color-separated image data. These image forming units (hereinafter, referred to simply as "units") 10Y; 10M, 10C and 10K are horizontally arranged at predetermined intervals. The units 10Y, 10M, 10C and 10K may be process cartridges that are detachably attachable to the main body of the image forming apparatus.

Above (in the figure) the units 10Y, 10M, 10C and 10K is disposed an intermediate transfer belt 20 that serves as an intermediate transfer member through the respective units. The intermediate transfer belt 20 is trained on a driving roller 22 and a support roller 24 in contact with the inner surface of the intermediate transfer belt 20, which rollers 22 and 24 are disposed at a distance. The intermediate transfer belt 20 runs in a direction from the first unit 10Y to the fourth unit 10K. The support roller 24 is biased by a spring or the like (not shown) to a direction away from the driving roller 22, so that a predetermined tension is provided to the intermediate transfer belt 20 trained around the two rollers. An intermediate transfer member cleaning unit 30 is provided at the image-holding side of the intermediate transfer belt 20, which intermediate transfer member cleaning unit 30 faces the driving roller 22.

Toners of four colors (yellow, magenta, cyan and black) accommodated in toner cartridges 8Y, 8M, 8C and 8K can be supplied to developing units (developing devices) 4Y, 4M, 4C and 4K in the units 10Y, 10M, 10C and 10K, respectively.

Since the first to fourth units 10Y, 10M, 10C and 10K have similar constitutions, the following explanation will be given only for the first unit 10Y as a representative unit that forms a yellow image and is arranged upstream in a running direction of the intermediate transfer belt. In the second to fourth units, members that are equivalent to those in the first unit 10Y are provided with reference characters having the characters M (magenta), C (cyan), and K (black), respectively, in place of Y (yellow), and descriptions of the second to fourth units 10M, 10C and 10K will be omitted.

The first unit 10Y has a photoreceptor 1Y that serves as an image holding member. Around the photoreceptor 1Y are provided a charging roller 2Y that charges the surface of the photoreceptor 1Y to a predetermined potential, an exposure unit 3 that exposes the charged surface to laser light 3Y in accordance with color-separated image signals to form an electrostatic image, a developing unit 4Y that develops the electrostatic image by supplying a charged toner to the electrostatic image, a primary transfer roller 5Y (primary transfer unit) that transfers the developed toner image onto the intermediate transfer belt 20, and a photoreceptor cleaning unit 6Y that removes a toner remaining on the surface of the photoreceptor 1Y after the primary transfer, in this order.

The primary transfer roller 5Y is arranged at the inner side of the intermediate transfer belt 20, at a position opposite to the photoreceptor 1Y. The primary transfer rollers 5Y, 5M, 5C and 5K are respectively connected to bias power sources (not shown) that apply primary transfer bias. The bias power sources are controlled by a control part (not shown) so that the transfer bias applied to the corresponding primary transfer roller can be changed.

Hereinafter, operation of forming a yellow image in the first unit 10Y will be described. Prior to the operation, the surface of the photoreceptor 1Y is charged to have a voltage of about −600 V to about −800 V with a charging roller 2Y.

The photoreceptor 1Y is formed by providing a photosensitive layer on an electroconductive substrate. This photosensitive layer is usually highly electrically-resistant (with approximately the same level of resistance as that of a common type of resin), but has such a property that upon irradiation with laser beam 3Y, the specific resistance of the portion that has been irradiated with the laser beam is changed. According to image data for yellow sent from a control part (not shown), the layer beam 3Y is radiated from the exposure device 3 onto the surface of the charged photoreceptor 1Y. The photosensitive layer on the surface of the photoreceptor 1Y is irradiated with the laser beam 3Y, thereby forming an electrostatic image in a yellow print pattern on the surface of the photoreceptor 1Y.

An electrostatic image is an image formed on the surface of the photoreceptor 1Y by means of electrification, and is a so-called negative latent image. The electrostatic image is formed by lowering the specific resistance at a portion by irradiating with laser beam 3Y so that the electric charge of the surface of the photoreceptor 1Y runs, whereas the electric charge remains at the portion that has not been irradiated with laser beam 3Y.

The electrostatic image thus formed on the photoreceptor 1Y is transported to a predetermined development position according to the rotation of the photoreceptor Y. At this development position, the electrostatic image on the photoreceptor 1Y is converted to a visual image (developed image) by developing unit 4Y.

In the developing unit 4Y, for example, a yellow toner having a volume-average particle diameter of 7 μm and containing at least a yellow colorant, a crystalline resin and a non-crystalline resin, is accommodated. The yellow toner is stirred in the developing device 4Y to be electrified by means of friction, and is retained on a development roll (developer holding member) with a charge having the same polarity as that of the charge on the photoreceptor 1Y (negative polarity). Upon passage of the surface of the photoreceptor 1Y by the developing unit 4Y, the yellow toner adheres electrostatically to the electrically neutralized latent image portion on the surface of the photoreceptor Y, thereby developing the latent image with the yellow toner. The photoreceptor 1Y having the yellow toner image formed thereon continues to be rotated at a predetermined speed, and the developed toner image on the photoreceptor 1Y is conveyed to a predetermined primary transfer position.

When the yellow toner image on the photoreceptor 1Y is transported to the primary transfer position, a predetermined primary transfer bias is applied to the primary transfer roller 5Y, so that an electrostatic force directed from the photoreceptor 1Y to the primary transfer roller 5Y acts on the toner image, thereby transferring the toner image onto the intermediate transfer belt 20. The transfer bias applied at this time has a polarity of (+), which is opposite to the polarity of the toner (−). For example, the transfer bias is regulated to about +10 μA by a control part (not shown) in the first unit 10Y.

On the other hand, the toner remaining on the photoreceptor 1Y is removed and collected by a cleaning unit 6Y.

The primary transfer bias applied to each of primary transfer rollers 5M, 5C and 5K of the second unit 10M, the third unit 10C, and the fourth unit 10K is also controlled in a manner similar to the first unit.

The intermediate transfer belt 20 having the yellow toner image that has been transferred thereon in the first unit 10Y is moved through the second to fourth units 10M, 10C, and 10K in this order, where toner images of respective colors are transferred and superposed.

The intermediate transfer belt 20, on which toner images of four colors have been transferred through the first to fourth units, reaches a secondary transfer part composed of the intermediate transfer belt 20, the support roller 24 in contact with the inner surface of the intermediate transfer belt 20, and a secondary transfer roller (secondary transfer unit) 26 disposed at the image-holding surface side of the intermediate transfer belt 20. A recording medium (image receiving medium) P is supplied by a feeding mechanism at a predetermined timing to a nip portion between the secondary transfer roller 26 and the intermediate transfer belt 20, and a predetermined secondary transfer bias is applied to the support roller 24. The transfer bias to be applied has the same (−) polarity as the polarity (−) of the toner, and electrostatic force directed from the intermediate transfer belt 20 to the recording medium P acts on the toner image, thereby transferring the toner image onto the recording medium P. The amount of the secondary transfer bias is determined depending on the resistance detected by a resistance detector (not shown) that detects the resistance at the secondary transfer part, and is subjected to voltage control.

Thereafter, the recording medium P is conveyed to a fixing unit 28 where the toner image is heated, and the superposed toner images are fused and fixed on the recording medium P. After the completion of the fixation of the color image, the recording medium P is conveyed to a discharging part, finishing the color image forming operation.

In the image forming apparatus in this exemplary embodiment, employing the toner having the aforementioned characteristics, processing can be carried out at a relatively high speed and sufficient fixability can be obtained without increasing fixing pressure at a fixing unit.

Specifically, in the image forming apparatus in this exemplary embodiment, sufficient image fixability can be obtained at a fixing pressure (in a system with two fixing rolls, a nipping pressure between the two rolls which is expressed by dividing the total load applied between the fixing rolls, or between the fixing roll and a fixing belt, by the area of the nipped portion) of from 0.5 kg/cm$^2$ or about 0.5 kg/cm$^2$ to 1.5 kg/cm$^2$ or about 1.5 kg/cm$^2$, and a fixing time (in the above case, a time for passing through the nipped portion) of from 10 msec or about 10 msec to 30 msec or about 30 msec, when a fixing temperature in the fixing unit 28 is set to the range of from 100° C. or about 100° C. to 135° C. or about 135° C. (more preferably from 100° C. to 120° C.).

The above fixing pressure is more preferably in the range of from 0.5 kg/cm$^2$ to 0.75 kg/cm$^2$, and the above fixing time is more preferably from 10 msec to 19 msec.

Although the image forming apparatus illustrated above is configured to transfer a toner image onto the recording medium P via the intermediate transfer belt 20, the configuration is not limited thereto. For example, a configuration may be adopted in which a toner image is transferred from the photoreceptor directly onto the recording paper.

<Process Cartridge and Toner Cartridge>

Figure 2:
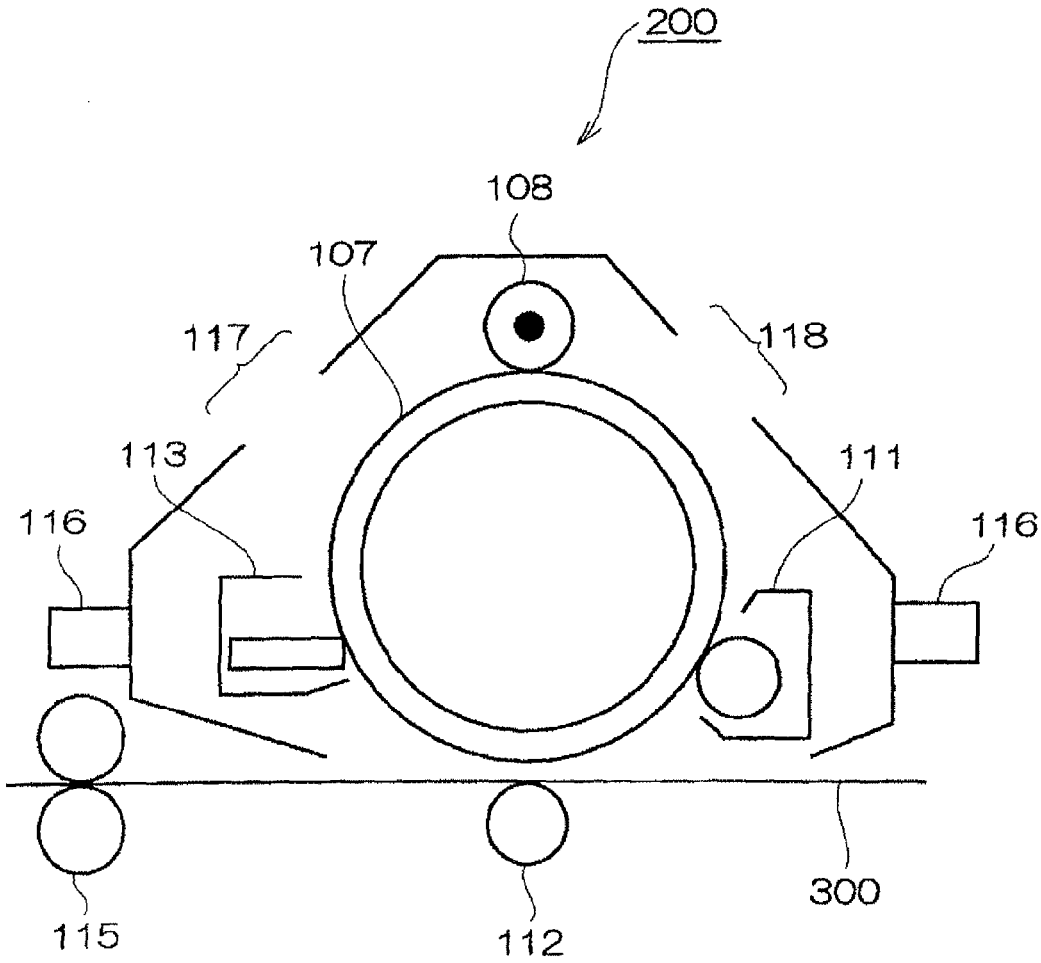
FIG. 2 is a schematic view of an exemplary embodiment of the process cartridge of the invention.

FIG. 2 is a schematic constitutional view showing one example of the process cartridge that contains the electrostatic image developer according to the above exemplary embodiment. The process cartridge 200 includes a photoreceptor 107, a charging roller 108, a developing unit 111, a photoreceptor cleaning unit 113 an opening 118 for light exposure, and an opening 117 for light exposure for charge removing, which are combined and integrated by using an attachment rail 116.

The process cartridge 200 is detachably attachable to the main body of the image forming apparatus that includes the transfer unit 112, the fixing unit 115 and other constituent parts (not shown), and constitutes the image forming apparatus together with the main body of the image forming apparatus. The reference number 300 indicates a recording medium.

Although the process cartridge shown in FIG. 2 includes the charging unit 108, the developing unit 111, the cleaning unit 113, the opening 118 for light exposure, and the opening 117 for light exposure for charge removing, these units may be appropriately selected and combined. The process cartridge according to the invention includes, other than the photoreceptor 107, at least one member selected from the group consisting of the charging unit 108, the developing unit 111, the cleaning unit 113, the opening 118 for light exposure, and the opening 117 for light exposure for charge removing.

Next, the toner cartridge in an exemplary embodiment of the invention will be described. The toner cartridge in this exemplary embodiment can be detachably attached to the image forming apparatus and accommodates at least a toner to be supplied to a developing unit in the image forming apparatus, wherein the toner is the toner in the aforementioned exemplary embodiment. The toner cartridge in this exemplary embodiment includes at least the above toner and, depending on the mechanism of the image forming apparatus, may further include a developer.

Accordingly, by using a toner cartridge containing the toner according to the invention in an image forming apparatus to which the toner cartridge can be detachably attached, storability of a toner can be maintained even with a toner cartridge having a reduced size, and low-temperature fixation can be carried out while maintaining high quality of obtained images.

The image forming apparatus shown in FIG. 1 is configured such that the toner cartridges 8Y, 8M, 8C and 8K can be detachably attached thereto, and the developing units 4Y, 4M, 4C and 4K are connected via toner feeding pipes (not shown) to each of the toner cartridges of corresponding developing units (colors). When the amount of the toner in the toner cartridge becomes small, the toner cartridge can be replaced with a new one.

EXAMPLES

Hereinafter, the invention will be described in details with reference to the examples. However, these examples are not intended to limit the scope of the invention. In the following, the terms "parts" refers to "parts by weight" and "%" refers to "% by weight", unless otherwise specified.

Method of Measuring Characteristics of Toner (Particle Diameter and Particle Size Distribution)

When the particle size to be measured is 2 μm or more, a Coulter MultiSizer (manufactured by Beckman Coulter K. K.) is used for the measuring device, and ISOTON-II (manufactured by Beckman Coulter K. K.) is used for the electrolyte.

The measurement is conducted by adding 0.5 mg to 50 mg of a measurement sample in 2 ml of a surfactant as a dispersant, preferably a 5% aqueous solution of sodium alkylbenzenesulfonate, then adding the mixture to 100 ml to 150 ml of the aforementioned electrolyte and carrying out dispersing by an ultrasonic disperser for about 1 minute. Thereafter, the particle size distribution of 50,000 particles having diameters of from 2.0 μm to 60 μm is measured using the aforementioned Coulter MultiSizer with an aperture diameter of 100 μm.

On the other hand, when the particle size to be measured is less than 2 μm, the measurement is carried out by a laser diffraction particle size distribution measuring device (LA-700, manufactured by HORIBA, Ltd.). The measurement method is that the solid content of the sample in the form of a dispersion is adjusted to about 2 g, and the amount thereof is adjusted to about 40 ml by adding ion exchange water. The resultant is put in a cell to give an appropriate density and allowed to stand for two minutes, and when the density in the cell becomes almost stable, measurement is conducted. The volume average particle diameter is defined as the accumulated value at a point of 50% where the volume average particle diameters obtained from respective channels are accumulated in ascending order.

The measurement of powder such as external additive is conducted by adding 2 g of a measurement sample to 50 ml of a surfactant, preferably a 5% aqueous solution of sodium alkylbenzenesulfonate, and dispersing it for two minutes using an ultrasonic disperser (1,000 Hz), and then carrying out the measurement in a similar manner to that of the aforementioned case using a dispersion.

(Average Circularity)

The average circularity of the toner is measured by a measuring device, FPIA-2100 manufactured y Sysmex Corporation). In this device, a method of measuring particles that are dispersed in water or the like by flow image analysis is employed, in which a suspension of particles that has been suctioned is introduced to a flat sheath flow cell and formed into a flat sample current with a sheath liquid. The sample current is irradiated with flash light and a static image of particles passing through is taken by a CCD camera via an objective lens. The image taken is processed into a two-dimensional image, and the circle equivalent diameter and circularity are calculated from the projected area and peripheral measurement of the two-dimensional image.

The circle equivalent diameter is defined as the diameter of a circle having the same area as that of the two-dimensional images of respective particles. By performing an image analysis and a statistical processing of at least 50,000 images of particles, the number average particle diameter and number average particle diameter variation are calculated. The circularity is also calculated by performing an image analysis and a statistical processing of at least 50,000 images of particles, in accordance with the following equation.

$$\text{Circularity} = \text{circle equivalent peripheral measurement}/\text{peripheral measurement} = [2\times(A\pi)^{1/2}]/PM$$

In the above equation, A represents a projected area and PM represents a peripheral measurement. The measurement is conducted in a HPF (high pass filter) mode and the dilution rate is set at 1.0 time. In the analysis of the data, the ranges of number average particle diameter and circularity to be analysed are set to from 2.0 μm to 30.1 μm and from 0.40 to 1.00, respectively.

(Acid Value)

The acid value (AV) of the resin is measured in the following manner. The basic operation thereof is based on the Japanese Industrial Standard (JIS) K-0070-1992.

The sample is prepared by removing insoluble components to THF from a binder resin in advance, or by extracting soluble components to THF using a Soxhlet extractor, which is obtained by measuring the aforementioned insoluble components to THF.

The pulverized sample is precisely measured and put in a 300 ml beaker with 100 ml of mixed solution of toluene and ethanol at a ratio of 4/1 (toluene/ethanol), and dissolved. Potentiometric titration is performed with 0.1 mol/l of an ethanol solution of KOH, using an automatic titrator, GT-100 (trade name) manufactured by Dia Instruments Co., Ltd. The amount of KOH solution used at this time is defined as A (ml). The blank is also measured and the amount of KOH solution used at this time is defined as B (ml). The acid value is calculated from the following equation.

$$\text{Acid value(mgKOH/g)} = \{(A-B)\times f\times 5.61\}/w$$

In the above equation, w is the precisely measured amount of the sample and f represents a factor of KOH.

<Preparation of Each Dispersion>

(Preparation of Crystalline Polyester Resin Dispersion (A))

An acid component composed of 98 mol % of dimethyl sebacate and 2 mol % of sodium dimethyl isophthalate-5-sulfonate, and an alcohol component composed of ethylene glycol are put in a heat-dried flask having three openings at a ratio of 1:1, and 0.3 parts of dibutyltin oxide with respect to 100 parts of the above components is added as a catalyst. The flask is decompressed and filled with nitrogen gas to produce an inert atmosphere, and then agitation and reflux are performed at 180° C. for five hours by machine agitation. Thereafter, the temperature is gradually increased up to 230° C. under reduced pressure and further agitated for two hours, and when the mixture becomes thick, it is air-cooled to stop the reaction, thereby obtaining a crystalline polyester resin (a).

The weight average molecular weight (Mw) measured by gel permeation chromatography (based on polystyrene) of the obtained crystalline polyester resin (a) is 9,700. When the melting temprature (Tm) of the crystalline polyester resin (a) is measured in a similar manner to the aforementioned first temperature increasing process by differential scanning calorimetry (DSC), a clear endothermic peak is observed and the temperature at the endothermic peak is 76.1° C.

90 parts of crystalline polyester resin (a), 1.8 parts of anionic surfactant (trade name: NEOGEN RK, manufactured by Dai-ichi Kogyo Seiyaku Co., Ltd.), and 210 parts of ion exchange water are mixed and heated to 100° C., sufficiently dispersed by a homogenizer (trade name: ULTRA-TURRUX T50, manufactured by IKA Japan K.K.) and subjected to a dispersion treatment by a pressure-ejection type Gaulin homogenizer for one hour. Thereafter, the pH in the system is adjusted to 12.5 with 0.5 mol/l aqueous solution of sodium hydroxide and processed at 96° C. for six hours, and then the pH is adjusted to 7.0 with a nitric acid aqueous solution. The solid content of the mixture is further adjusted, thereby obtaining a crystalline polyester resin dispersion (A) having a volume average particle diameter of 200 nm and a solid content of 30%.

(Preparation of Crystalline Polyester Resin Dispersion (B))

An acid component composed of 90.5 mol% of 1,10-dodecandioic acid, 2 mol% of sodium dimethyl isophthalate-5-sulfonate and 7.5 mol% of 5-t-butyl isophthalate, and an alcohol component composed of 1,9-nonanediol are put in a heat-dried flask having three openings at a ratio of 1:1, and 0.3 parts of dibutyltin oxide with respect to 100 parts of the above components is added as a catalyst. The flask is decompressed and filled with nitrogen gas to produce an inert atmosphere, and then agitation and reflux are performed for five hours at 180° C., by machine agitation. Thereafter, the temperature is gently increased up to 230° C. under reduced pressure and agitated for four hours, and when the mixture becomes thick, it is air-cooled to stop the reaction, thereby obtaining a crystalline polyester resin (b).

The weight average molecular weight (Mw) measured by gel permeation chromatography (based on polystyrene) of the obtained crystalline polyester resin (b) is 28,000. When the melting temperature (Tm) of the crystalline polyester resin (b) is measured in a similar manner to the aforementioned method by differential scanning calorimetry (DSC), a clear endothermic peak is observed and the temperature at the endothermic peak is 72° C.

90 parts of crystalline polyester resin (b), 1.8 parts of anionic surfactant (trade name: NEOGEN RK, manufactured by Dai-ichi Kogyo Seiyaku Co., Ltd.), and 210 parts of ion exchange water are mixed and heated to 100° C., sufficiently dispersed by a homogenizer (trade name: ULTRA-TURRUX T50, manufactured by IKA Japan K.K.) and subjected to a dispersion treatment by a pressure-ejection type Gaulin homogenizer for one hour. Thereafter, the pH in the system is adjusted to 13.0 with 0.5 mol/l aqueous solution of sodium hydroxide and processed at 96° C. for eight hours, and then the pH is adjusted to 7.0 with a nitric acid aqueous solution. The solid content of the mixture is further adjusted, thereby obtaining a crystalline polyester resin dispersion (B) having a volume average particle diameter of 300 nm and a solid content of 30%.

(Preparation of Non-Crystalline Polyester Resin Dispersion (C))

An acid component composed of 30 mol % of terephthalic acid and 70 mol % of fumaric acid, and an alcohol component composed of 20 mol % of bisphenol A to which 2 mols of ethylene oxide is added and 20 mol % of bisphenol A to which 2 mols of propylene oxide is added are put at a ratio of 1:1 in a 5 liter flask equipped with an agitator, a nitrogen-introduction tube, a temperature sensor and a rectifier, and the temperature thereof is increased to 190° C. taking one hour. It is observed that the content of the system is uniformly agitated. Thereafter, 1.2 parts of dibutyltin oxide with respect to 100 parts of the above components is added and the temperature is further increased to 240° C. taking six hours while distilling off the water generated, and dehydration-condensation reaction is further continued at 240° C. for three hours, thereby obtaining a non-crystalline polyester resin (c) having an acid value of 12.0 mgKOH/g and a weight average molecular weight of 9,700.

Subsequently, the obtained non-crystalline polyester resin (c) remaining in a molten state is transferred into an emulsion disperser (trade name: CAVITRON CD 1010, manufactured by Eurotec, Ltd.) at a rate of 100 g/minute. In a separate aqueous medium tank, 0.37% dilute ammonia water prepared by diluting test ammonia water with ion exchange water is put and is transferred into the emulsion disperser concomitantly with the molten non-crystalline polyester resin (c) at a rate of 0.1 liter/minute while being heated to 120° C. by a heat exchanger. The emulsion disperser is operated at a rotation rate of rotator of 60 Hz and a pressure of 5 kg/cm$^2$. Thereafter, the pH in the system is adjusted to 13.0 with 0.5 mol/l aqueous solution of sodium hydroxide and the treatment is conducted at 96° C. for eight hours, and then the pH is adjusted to 7.0 with a nitric acid aqueous solution. The solid content of the mixture is further adjusted, thereby obtaining a non-crystalline polyester resin dispersion (C) having a volume average particle diameter of 160 nm and a solid content of 30%.

(Preparation of Non-Crystalline Polyester Resin Dispersion (D))

A non-crystalline polyester resin (d) is prepared in a similar manner to the non-crystalline polyester resin (c) except that the acid component is composed of 60 mol % of terephthalic acid, 10 mol % of trimellitic anhydride and 30 mol % of dodecenyl succinate, and an alcohol component is composed of 50 mol % of bisphenol A to which 2 mols of ethylene oxide is added and 50 mol % of bisphenol A to which 2 mols of propylene oxide, at a ratio of 1:1. The non-crystalline polyester resin (d) thus obtained has an acid value of 17.0 mgKOH/g and a weight average molecular weight of 16,000.

Subsequently, the non-crystalline polyester resin dispersion (D)) is prepared in a similar manner to the non-crystalline polyester resin dispersion (C). The non-crystalline polyester resin dispersion (D) thus obtained has a volume average particle diameter of 150 nm and a solid content of 30%.

(Preparation of Styrene/Acrylic Resin Dispersion (E1))

370 parts of styrene, 30 parts of n-butyl acrylate, 8 parts of acrylic acid, 24 parts of dodecanethiol and 4 parts of carbon tetrabromide are mixed and dissolved, and put in a flask together with 6 parts of a nonionic surfactant (trade name: NONIPOL 400, manufactured by Sanyo Chemical Industries, Ltd.) and 10 parts of anionic surfactant (trade name: NEOGEN SC, Dai-ichi Kogyo Seiyaku Co., Ltd.), which are dissolved in 550 parts of ion exchange water, and the mixture is dispersed and emulsified. While slowly mixing for 10 minutes, 50 parts of ion exchange water in which 4 parts of ammonium persulfate is dissolved is put in the mixture and, after performing nitrogen-substitution, the mixture is heated to 70° C. in an oil bath while agitating, and in the same condition emulsion aggregation is continued for five hours. Thereafter, the pH in the system is adjusted to 12.5 with a 0.5 mol/l aqueous solution of sodium hydroxide and treatment is carried out at 96° C. for six hours. The pH is then adjusted to 3.0 with a nitric acid aqueous solution and the solid content of the mixture is adjusted, thereby obtaining a styrene/acrylic acid resin dispersion (E1) having a volume average particle diameter of 155 nm, glass transition temperature of 59° C., weight average molecular weight of 12,000 and a solid content of 40%.

(Preparation of Styrenelacrylic Resin Dispersion (E2))

280 parts of styrene, 120 parts of n-butyl acrylate and 8 parts of acrylic acid are mixed and dissolved, and put in a flask together with 6 parts of a nonionic surfactant (trade name: NONIPOL 400, manufactured by Sanyo Chemical Industries, Ltd.) and 12 parts of anionic surfactant (trade name: NEOGEN SC, Dai-ichi Kogyo Seiyaku Co., Ltd.), which are dissolved in 550 parts of ion exchange water, and the mixture is dispersed and emulsified. While slowly mixing for 10 minutes, 50 parts of ion exchange water in which 3 parts of ammonium persulfate is dissolved is put in the mixture and, after performing nitrogen-substitution, the mixture is heated to 70° C. in an oil bath while agitating, and in the same condition emulsion aggregation is continued for five hours. Thereafter, the pH in the system is adjusted to 12.5 with a 0.5 mol/l aqueous solution of sodium hydroxide and treatment is carried out at 96° C. for six hours. The pH is then adjusted to 3.0 with a nitric acid aqueous solution and the solid content of the mixture is further adjusted, thereby obtaining a styrene/acrylic acid resin dispersion (E2) having a volume average particle diameter of 105 nm, glass transition temperature of 53° C., weight average molecular weight of 550,000 and a solid content of 40%.

(Preparation of Colorant Dispersion)

45 parts of cyan pigment (trade name: C. I. Pigment Blue 15:3 (copper phthalocyanine), manufactured by Dainichiseika Color & Chemicals Mfg. Co., Ltd.), 5 parts of anionic surfactant (trade name: NEOGEN RK, manufactured by Dai-ichi Kogyo Seiyaku Co., Ltd.) and 200 parts of ion exchange water are mixed and dissolved, and the mixture is dispersed by a homogenizer (trade name: ULTRA-TURRUX T50, manufactured by IKA Japan K.K.) for ten minutes. The colorant dispersion having a volume average particle diameter of 168 nm and a solid content of 23.0% is thus obtained.

(Preparation of Releasing Agent Dispersion (F))

45 parts of carnauba wax (melting temperature: 81° C.), 5 parts of anionic surfactant (trade name: NEOGEN RK, manufactured by Dai-ichi Kogyo Seiyaku Co., Ltd.) and 200 parts of ion exchange water are mixed and heated to 95° C. The mixture is sufficiently dispersed by a homogenizer (trade name: ULTRA-TURRUX T50, manufactured by IKA Japan K.K.), and is subjected to a dispersion treatment by a pressure-ejection type Gaulin homogenizer. The releasing agent dispersion (F) having a volume average particle diameter of 200 nm and a solid content of 20% is thus obtained.

(Preparation of Releasing Agent Dispersion (G))

5 parts of pentaerythritol/behenic acid ester wax (melting temperature: 84.5° C.), 5 parts of anionic surfactant (trade name: NEOGEN RK, manufactured by Dai-ichi Kogyo Seiyaku Co., Ltd.) and 200 parts of ion exchange water are mixed and heated to 95° C. The mixture is sufficiently dispersed by a homogenizer (trade name: ULTRA-TURRUX T50, manufactured by IKA Japan K.K.), and is subjected to a dispersion treatment by a pressure-ejection type Gaulin homogenizer. The releasing agent dispersion (G) having a volume average particle diameter of 220 nm and a solid content of 20% is thus obtained.

(Preparation of Releasing Agent Dispersion (H))

45 parts of paraffin wax (trade name: HNP-9, manufactured by Nippon Seiro Co., Ltd., melting temperature: 75° C.), 5 parts of anionic surfactant (trade name: NEOGEN RK, manufactured by Dai-ichi Kogyo Seiyaku Co., Ltd.) and 200 parts of ion exchange water are mixed and heated to 95° C. The mixture is sufficiently dispersed by a homogenizer (trade name: ULTRA-TURRUX T50, manufactured by IKA Japan K.K.), and is subjected to a dispersion treatment by a pressure-ejection type Gaulin homogenizer. The releasing agent dispersion (H) having a volume average particle diameter of 190 nm and a solid content of 20% is thus obtained.

Example 1

(Preparation of Toner)

Toner matrix particles (1) are prepared in the following process.

95.0 parts of the non-crystalline polyester resin dispersion (C), 95.0 parts of the non-crystalline polyester resin dispersion (D), 18.0 parts of the crystalline polyester resin dispersion (B), 22.0 parts of the colorant dispersion and 50.0 parts of the releasing agent dispersion (H) are put in a round stainless steel flask and the pH is adjusted to 2.5 using a nitric aqueous solution, and are sufficiently mixed and dispersed by a homogenizer (trade name: ULTRA-TURRUX T50). Subsequently, 0.35 parts of polyaluminum chloride is added and the dispersion process is continued. Thereafter, the flask is heated to 48° C. in an oil bath while agitating and left to stand for 60 minutes at 48° C., and 33.3 parts of the non-crystalline polyester resin dispersion (C) and 33.3 parts of the non-crystalline polyester resin dispersion (D) are further added therein. The pH in the system is then adjusted to 7.8 with a 0.5 mol/l aqueous solution of sodium hydroxide, and the flask is tightly sealed and heated to 89° C. while agitating using a magnetic seal, and is left to stand for three hours.

After the completion of the reaction, cooling, filtering and thorough washing with ion exchange water of the mixture are performed. Thereafter, the mixture is subjected to solid-liquid separation by Nutsche suction filtration. The resultant solid is dispersed again in 1 liter of ion exchange water at 40° C., and agitation/washing is performed at 300 rpm for 15 minutes. This process is repeated five more times and when the pH of the filtered liquid becomes 7.5 and the electroconductivity thereof becomes 7.0 μS/cmt, solid-liquid separation is performed by Nutsche suction filtration using a No. 5A filter paper. The resultant solid is vacuum-dried for 12 hours, and is then put in a bat placed on a shelf and leveled to a toner thickness of from 5 mm to 1 cm. This is dried while ventilating at an atmosphere temperature of 48° C. for 24 hours, and is then sieved to obtain toner matrix particles (1).

Next, 1.0 part of rutile-type titanium oxide (volume average particle diameter: 20 rim, treated with n-decyl trimethoxysilane), 2.0 parts of silica (prepared by a vapor-oxidization method, volume average particle diameter: 40 nm, treated with a silicone oil) and 2.0 parts of silica (prepared by a sol-gel method, volume average particle diameter: 140 nm, treated with a silicone oil) are added to 100 parts of toner matrix particles (1), and blending is performed at a peripheral velocity of 30 m/s for 15 minutes by a 5-liter Henschel mixer. The resultant is sieved by a 45-μm mesh sieve to eliminate coarse particles, thereby obtaining a toner with an external additive (1).

(Evaluation of Toner)

—Particle Size Distribution—

The toner with an external additive (1) has a volume average particle diameter (D50v) of 7.7 μm, a particle size distribution coefficient (GSDv) of 1.23 and an average circularity of 0.93. The ratio of particles having circularities of less than 0.85 is 2.8% by number.

—Thermal Characteristic—

The peak temperature T1*a* of the toner before fixation of the toner with an external additive (1) is defined as 56° C., from the result of a DSC measurement that a stepwise peak with a peak temperature of 56° C. and a melting peak with a peak temperature of 68° C. are obtained at a first warm-up step. The peak temperature T2*a* of the toner before fixation is defined as 40° C. from the result of a DSC measurement that two peaks with peak temperatures of 40° C. and 70° C. are obtained at a second warm-up step.

On the other hand, the peak temperature T1*b* of the toner after fixation, which are obtained after performing fixation under the aforementioned conditions, is defined as 30° C. from the result of a DSC measurement that a stepwise peak with a peak temperature of 30° C. and a melting peak with a peak temperature of 40° C. are obtained at a first warm-up step.

From the above results, the values of T1*a* minus T1*b* and T2*a* minus T1*b* are determined as 26° C. and 10° C., respectively.

The toner after fixation used in the above DSC measurement is obtained by performing fixation by passing a sample sandwiched by PFA sheets through a fixing/heating rolls having a surface temperature of from +0° C. to +10° C. with respect to a fixing temperature at which the aforementioned favorable fixing properties can be obtained. The DSC measurement is conducted at 6 to 12 hours after the fixation.

—Blocking Resistance—

10 g of the toner is measured and put on a propylene cup and allowed to stand for 17 hours at 50° C. and 50% RH. Thereafter, the state of blocking (aggregation) of the toner is evaluated according to the following criteria. The results are shown in Table 1.

A: The toner smoothly runs down when the cup is tilted.

B: The toner gradually collapses and runs down when the cup is moved.

C; A block is formed in the toner, which collapses when poked with a pointed object.

D; A block is formed in the toner, which does not easily collapse even when poked with a pointed object.

—Real Machine Properties—

(1) Fixation Ability

A two-component developer is prepared by mixing 9 parts of toner with an external additive (1) and 100 parts of ferrite particles coated with a styrene/methyl methacrylate resin (volume average particle diameter: 35 μm), and this is used to form an unfixed solid image (3 cm square, toner amount: 15 g/cm$^2$) by a commercially available electrophotographic copier (trade name: DocuCentre Color 450, manufactured by Fuji Xerox Co., Ltd.). A 50% half-tone unfixed image is also formed for evaluation of offset. The paper used for evaluation (measurement of the lowest fixing temperature) is C2 paper (manufactured by Fuji Xerox Co., Ltd.) and the paper used for evaluation of offset is 4200 paper having a relatively rough surface (201b, manufactured by Xerox Corporation).

Subsequently, a belt-nip type fixing unit used in the DocuCentre Color 450 is replaced with an off-line fixing unit that can be externally driven and whose temperature can be controlled (fixing pressure: 0.75 kg/cm$^2$, fixing time: 30 msec), and while gradually increasing the fixing temperature from 100° C. to 200° C., the lowest temperature at which an image is fixed and a temperature at which hot offset occurs are measured and evaluated. The lowest fixing temperature is determined in the following manner:

The solid image (3 cm square) after being fixed is lightly folded inward and put on a flat desk, and a fold line is formed by rolling thereon with a roll having a weight of 860 g and a diameter of 76 mm at a rate of 150 mm/s. Thereafter, the image is unfolded and presence or absence of an image defect formed along the fold line is observed (with a scale loupe, magnification: 10 times). The temperature at which the maximum width of the fold line becomes 0.30 mm or less is determined as the lowest fixing temperature, and is used as an indicator for the low-temperature fixation ability. The temperature at which hot offset occurs is determined as a temperature at which an image offset is visually observed in the fixed toner image at a position corresponding to the second rotation of a fixing roll.

(2) Image Maintainability

Two solid images (3 cm square, toner amount: 15 g/cm$^2$) obtained in the conditions in which favorable results of the aforementioned fixation ability evaluation are obtained are prepared. The paper on which images are formed is cut in the size of 5 cm square so as to leave a margin of 1 cm width around the solid images. The cutout pieces are superposed so that the images thereof face to each other, and are placed on a glass plate having a size of 10 cm square or more. Onto the cutout pieces, a glass plate having a size of 5 cm square and a thickness of 1 mm is placed, and a weight of 250 g with a bottom area of 5 cm square is further placed thereon. This is allowed to stand for one week at high temperature (50° C. and 50% RH), and image defects that are formed when two fixed images are separated are observed according to the following criteria.

A: No image defect is observed and no sound is generated when separating the images.

B: No image defect is observed but a crisp sound is generated when separating the images.

C: A white defect having a diameter of less than 0.5 mm and gloss unevenness are observed.

D: A white defect having a diameter of 0.5 mm or more and gloss unevenness are observed.

(3) Toner Chargeability

Images having an image area ratio of 5% are formed on A4 size C2 paper sheets (manufactured by Fuji Xerox Co., Ltd.) using the aforementioned image forming apparatus (equipped with a developing unit). The developer at the commencement of the printing and the developer after printing 100,000 images are collected from the magnet roll, and the chargeability is measured.

The measurement of the chargeability is performed by a blow-off method using a charge measuring device (trade name: TB-200, manufactured by Toshiba Corporation). The measurement is conducted under the conditions that the pressure of the air for blow-off is 1.0 kg/cm$^3$ and the amount of the measurement sample is 0.2 g.

(4) Anti-Filming Property

After the above 100,000 printing, an A3 half-tone full image whose Cin (image density coverage that represents and image area ratio per dot of image input data) is 30% is sampled, and damages on image quality and toner filming on the photoreceptor and development roll are visually observed and evaluated according to the following criteria. In the criteria, grades A and B are considered to be acceptable, whereas grades C and D are not. The results are shown in Table 2.

A: No filming on the photoreceptor or development roll and no problem in image quality.

B: A slight degree of filming is found on the photoreceptor or development roll, but no problem is found in image quality.

C: Filming is observed on the photoreceptor or development roll, and image quality is damaged.

D: Filming is observed on the photoreceptor or development roll, and image quality is damaged to a significant level.

Example 2

Toner with an external additive (2) is prepared using the same materials as those of toner with an external additive (1), but under the different conditions as described below.

First, the pH of the mixture in the aforementioned round stainless steel flask is adjusted to 2.8 with a nitric aqueous solution, and sufficiently mixed and dispersed by ULTRA TURRAX T50. Next, 0.30 parts of polyaluminum chloride is added to the mixture and dispersing is continued. The resultant is heated in a similar manner to Example 1 to 43° C. and after maintaining at 43° C. for 60 minutes, 33.3 parts of non-crystalline polyester resin dispersion (C) and 33.3 parts of non-crystalline polyester resin dispersion (D) are gradually added. Thereafter, the pH in the system is adjusted to 8.3 with a 0.5 mol/l aqueous solution of sodium hydroxide and heated to 93° C. in a similar manner to Example 1, and allowed to stand for five hours. Other conditions are similar to those in Example 1.

The obtained toner with an external additive (2) has a volume average particle diameter D50v of 5.7 μm, a particle size distribution coefficient GSDv of 1.23, and an average circularity of 0.96. The ratio of particles having circularities of less than 0.85 is 0.4% by number.

Evaluation of toner with an external additive (2) is conducted in a similar manner to Example 1, and the results are shown in Tables 1 and 2.

Example 3

Toner with an external additive (3) is prepared in a similar manner to the preparation of toner in Example 1, except that the addition amount of polyaluminum chloride is changed from 0.35 parts to 0.40 parts and the heating temperature in the oil bath is changed from 48° C. to 50° C.

The above toner with an external additive (3) has a volume average particle diameter D50v of 8.0 μm, a particle size distribution coefficient GSDv of 1.27, and an average circularity of 0.93. The ratio of particles having circularities of less than 0.85 is 3.0% by number.

Evaluation of toner with an external additive (3) is conducted in a similar manner to Example 1, and the results are shown in Tables 1 and 2.

Example 4

Toner with an external additive (4) is prepared in a similar manner to the preparation of toner in Example 2, except that the time period in which the mixture is maintained at 93° C. is changed from five hours to nine hours.

The above toner with an external additive (4) has a volume average particle diameter D50v of 5.9 μm, a particle size distribution coefficient GSDv of 1.23, and an average circularity of 0.99. The ratio of particles having circularities of less than 0.85 is 0.1% by number.

Evaluation of the toner with an external additive (4) is conducted in a similar manner to Example 1, and the results are shown in Tables 1 and 2.

Example 5

Toner with an external additive (5) is prepared in a similar manner to the preparation of toner in Example 2, except that the addition amount of polyaluminum chloride is changed from 0.30 parts to 0.20 parts, the heating temperature in the oil bath is changed from 43° C. to 41° C., and the retention time thereafter is changed from 60 minutes to 15 minutes.

The above toner with an external additive (5) has a volume average particle diameter D50v of 3.3 μm, a particle size distribution coefficient GSDv of 1.3, and an average circularity of 0.96. The ratio of particles having circularities of less than 0.85 is 0.8% by number.

Evaluation of toner with an external additive (5) is conducted in a similar manner to Example 1, and the results are shown in Tables 1 and 2.

Example 6

Toner with an external additive (6) is prepared in a similar manner to the preparation of toner in Example 2, except that releasing agent dispersion (H) is changed to releasing agent dispersion (G).

The toner with an external additive (6) has a volume average particle diameter D50v of 5.7 μm, a particle size distribution coefficient GSDv of 1.23, and an average circularity of 0.96. The ratio of particles having circularities of less than 0.85 is 0.4% by number.

Evaluation of toner with an external additive (6) is conducted in a similar manner to Example 1, and the results are shown in Tables 1 and 2.

Example 7

Toner with an external additive (7) is prepared in a similar manner to the preparation of toner in Example 2, except that releasing agent dispersion (H) is changed to releasing agent dispersion (F).

The above toner with an external additive (7) has a volume average particle diameter D50v of 5.7 g/m, a particle size distribution coefficient GSDv of 1.23, and an average circularity of 0.96. The ratio of particles having circularities of less than 0.85 is 0.4% by number.

Evaluation of toner with an external additive (7) is conducted in a similar manner to Example 1, and the results are shown in Tables 1 and 2.

Example 8

(Preparation of Toner)

120 parts of styrene/acrylic resin dispersion (E1), 80 parts of styrene/acrylic resin dispersion (E2), 30 parts of colorant dispersion, 40 parts of releasing agent dispersion (H) and 0.3 parts of polyaluminum hydroxide (trade name: Paho2S, manufactured by Asada Chemical Industry Co., Ltd.) are put in a round stainless steel flask, mixed and dispersed by a homogenizer (trade name: ULTRA TURRAX T50, manufactured by IKA Japan K.K.), and this is then heated to 55° C. in an oil bath while agitating. After retaining the dispersion at 55° C. for 30 minutes, the particle size is observed by a Coulter Multisizer II (manufactured by Beckman Coulter, Inc.), and it is found that aggregate particles having a volume average particle size of about 4.5 μm are formed. Into the dispersion, 30 parts of styrene/acrylic resin dispersion (E1) and 30 parts of styrene/acrylic resin dispersion (E2) are gradually added and the temperature is raised, and maintained at 65° C. for one hour. The particles size is measured and it is observed that aggregate particles having a volume average particle size of about 5.3 μm are formed.

Subsequently, 3 parts of anionic surfactant (trade name: NEOGEN RK, manufactured by Dai-ichi Kogyo Seiyaku Co., Ltd.) is added to the dispersion containing aggregate particles and the flask is sealed. This is heated to 97° C. while continuing agitation with a magnetic seal, and is maintained for four hours. After cooling, the particle size is measured in a similar manner to the above, and the average particle size observed is 5.4 μm. Toner particles are separated from the liquid containing the toner particles by filtering, and are washed with a sodium hydroxide aqueous solution having a pH of 10.0, and are then washed with ion exchange water for three times. Thereafter, the toner particles are freeze-dried for six hours and vacuum-dried for 24 hours, then put in a bat placed on a shelf and leveled to a toner thickness of from 5 mm to 1 cm and dried under air flow at an atmosphere temperature of 48° C. for 24 hours. Sieving is performed and toner particles (8) are thus obtained.

(Evaluation of Toner)

Toner with an external additive (8) is prepared in a similar manner to Example 1 using the above toner particles (8). Toner with an external additive (8) has a volume average particle diameter D50v of 5.7 μm, a particle size distribution coefficient GSDv of 1.23, and an average circularity of 0.96. The ratio of particles having circularities of less than 0.85 is 0.2% by number.

Evaluation of toner with an external additive (8) is conducted in a similar manner to Example 1, and the results are shown in Tables 1 and 2.

Example 9

(Preparation of Toner)

41 parts of dry substance of non-crystalline polyester resin dispersion (C) (water content: 1% to 2%), 41 parts of dry substance of non-crystalline polyester resin dispersion (D) (water content: 1% to 2%), 6 parts of dry substance of crystalline polyester resin dispersion (B) (water content: 1% to 2%), 5 parts of cyan pigment (C.I. Pigment Blue 15:3 (copper phthalocyanine), manufactured by Dainichiseika Color & Chemicals Mfg. Co., Ltd.), and 7 parts of paraffin wax (trade name: HNP-9, manufactured by Nippon Seiro Co., Ltd., melting temperature: 75° C.) are mixed and kneaded by an extruder in such a condition that the temperature of extruded resin is from 100° C. to 120° C. The kneaded product is roughly pulverized and then finely pulverized, classified by an airflow-type classifier, and then subjected to a thermal conglobation treatment by a thermal treatment apparatus (trade name: SFS-3, manufactured by Nippon Pneumatic Mfg. Co., Ltd., airflow temperature: 280° C.). The resultant particles are further classified by the airflow-type classifier and are put in a bat placed on a shelf and leveled to a toner thickness of from 5 mm to 1 cm. This is dried at an atmosphere temperature of 48° C. under airflow for 24 hours, and toner particles (9) are thus obtained.

(Evaluation of Toner)

Toner with an external additive (9) is prepared in a similar manner to Example 1 using the above toner particles (9). Toner with an external additive (9) has a volume average particle diameter D50v of 6.4 μm, a particle size distribution coefficient GSDv of 1.3, and an average circularity of 0.95. The ratio of particles having circularities of less than 0.85 is 3.0% by number.

Evaluation of toner with an external additive (9) is conducted in a similar manner to Example 1, and the results are shown in Tables 1 and 2.

Example 10

Toner with an external additive (10) is prepared in a similar manner to Example 1, except that the addition amount of polyaluminum chloride is changed from 0.35 parts to 0.40 parts and the heating temperature in the oil bath is changed from 48° C. to 53° C.

The toner with an external additive (10) has a volume average particle diameter D50v of 9.0 μm, a particle size distribution coefficient GSDv of 1.35, and an average circularity of 0.93. The ratio of particles having circularities of less than 0.85 is 3.0% by number.

Evaluation of toner with an external additive (10) is conducted in a similar manner to Example 1, and the results are shown in Tables 1 and 2.

Example 11

Toner with an external additive (11) is prepared in a similar manner to Example 2, except that the addition amount of polyaluminum chloride is changed from 0.30 parts to 0.15 parts, the heating temperature in the oil bath is changed from 43° C. to 40° C., and the retention time after the heating is changed from 60 minutes to 12 minutes.

The toner with an external additive (11) has a volume average particle diameter D50v of 2.1 μm, a particle size distribution coefficient GSDv of 1.32, and an average circularity of 0.96. The ratio of particles having circularities of less than 0.85 is 0.8% by number.

Evaluation of toner with an external additive (11) is conducted in a similar manner to Example 1, and the results are shown in Tables 1 and 2.

Example 12

Toner with an external additive (12) is prepared in a similar manner to Example 2, except that non-crystalline polyester resin dispersion (C) and crystalline polyester resin dispersion (B) are changed to 113.0 parts of the following non-crystalline polyester resin mixture dispersion (I) with a solid content of 30%.

Non-crystalline polyester resin mixture dispersion (I) is prepared by a similar manner to the preparation of non-crystalline polyester resin dispersion (C), except that after mixing 5.4 parts of non-crystalline polyester resin (b) in a molten state with 23.5 parts of non-crystalline polyester resin (c), the mixture is transferred to the CAVITRON CD 1010 at a rate of 100 g/minute.

The toner with an external additive (12) has a volume average particle diameter D50v of 5.9 μm, a particle size distribution coefficient GSDv of 1.30, and an average circularity of 0.96. The ratio of particles having circularities of less than 0.85 is 0.9% by number.

Evaluation of the toner with an external additive (12) is conducted in a similar manner to Example 1, and the results are shown in Tables 1 and 2.

Toner with an external additive (13) is prepared in a similar manner to Example 12, except that 10.4 parts of non-crystalline polyester resin (b) is mixed with 23.5 parts of non-crystalline polyester resin (c).

Example 13

Toner with an external additive (13) has a volume average particle diameter D50v of 6.3μm, a particle size distribution coefficient GSDv of 1.33, and an average circularity of 0.96. The ratio of particles having circularities of less than 0.85 is 0.3% by number.

Evaluation of toner with an external additive (13) is conducted in a similar manner to Example 1, and the results are shown in Tables 1 and 2.

Toner with an external additive (14) is prepared in a similar manner to Example 2, except that shelf-drying is not performed.

Example 14

Toner with an external additive (14) has a volume average particle diameter D50v of 5.6μm, a particle size distribution coefficient GSDv of 1.23, and an average circularity of 0.96. The ratio of particles having circularities of less than 0.85 is 0.3% by number.

Evaluation of toner with an external additive (14) is conducted in a similar manner to Example 1, and the results are shown in Tables 1 and 2.

Comparative Example 1

41 parts of non-crystalline polyester resin (c), 41 parts of non-crystalline polyester resin (d), 6 parts of crystalline polyester resin (b), 5 parts of cyan pigment (C. I. Pigment Blue 15:3 (copper phthalocyanine), manufactured by Dainichiseika Color & Chemicals Mfg. Co., Ltd.), and 7 parts of paraffin wax (trade name: HNP-9, manufactured by Nippon Seiro Co., Ltd., melting temperature: 75° C.) are mixed and kneaded by an extruder in such a condition that the temperature of extruded resin is from 130° C. to 150° C. The kneaded product is roughly pulverized and then finely pulverized, classified by an airflow-type classifier, and then subjected to a thermal conglobation treatment. The resultant particles are further classified by the airflow-type classifier, and toner particles (15) are thus obtained.

Toner with an external additive (15) is prepared in a similar manner to Example 1 using the above toner particles (15). Toner with an external additive (15) has a volume average particle diameter D50v of 6.8 μm, a particle size distribution coefficient GSDv of 1.33, and an average circularity of 0.92. The ratio of particles having circularities of less than 0.85 is 5.0% by number.

Evaluation of the toner with an external additive (15) is conducted in a similar manner to Example 1, and the results are shown in Tables 1 and 2.

Comparative Example 2

Toner with an external additive (16) is prepared in a similar manner to Example 2, except that non-crystalline polyester resin dispersion (C) and crystalline polyester resin dispersion (B) are changed to 113.0 parts of the following non-crystalline polyester resin mixture dispersion (J) with a solid content of 30%.

Non-crystalline polyester resin mixture dispersion (J) is prepared in a similar manner to the preparation of non-crystalline polyester resin dispersion (C), except that after mixing 10.8 parts of non-crystalline polyester resin (b) in a molten state with 28.5 parts of non-crystalline polyester resin (c), the mixture is transferred to the CAVITRON CD 1010 at a rate of 100 g/minute.

Toner with an external additive (16) has a volume average particle diameter D50v of 6.1 μm, a particle size distribution coefficient GSDv of 1.33, and an average circularity of 0.96. The ratio of particles having circularities of less than 0.85 is 0.6% by number.

Evaluation of toner with an external additive (16) is conducted in a similar manner to Example 1, and the results are shown in Tables 1 and 2.

TABLE 1

| Toner with external additive | Volume average particle size (μm) | Average circularity | Particles with circularity of less than 0.85 (% by number) | T1a (° C.) | T2a (° C.) | T1b (° C.) | T1a-T1b (° C.) | T2a-T1b (° C.) | Anti-blocking property |
|---|---|---|---|---|---|---|---|---|---|
| (1) | 7.7 | 0.93 | 2.8 | 56 | 40 | 30 | 26 | 10 | A |
| (2) | 5.7 | 0.96 | 0.4 | 55 | 38 | 29 | 26 | 9 | B |
| (3) | 8.0 | 0.93 | 3.0 | 53 | 39 | 31 | 22 | 8 | A |
| (4) | 5.9 | 0.99 | 0.1 | 54 | 37 | 29 | 25 | 8 | B |
| (5) | 3.3 | 0.96 | 0.8 | 55 | 38 | 30 | 25 | 8 | B |
| (6) | 5.7 | 0.96 | 0.4 | 56 | 39 | 29 | 27 | 10 | A |
| (7) | 5.7 | 0.96 | 0.4 | 53 | 38 | 29 | 24 | 9 | A |
| (8) | 5.7 | 0.96 | 0.2 | 62 | 49 | 48 | 14 | 1 | A |
| (9) | 6.4 | 0.95 | 3.0 | 42 | 38 | 29 | 13 | 9 | A |
| (10) | 9.0 | 0.93 | 3.0 | 56 | 39 | 32 | 24 | 7 | A |
| (11) | 2.1 | 0.96 | 0.8 | 57 | 40 | 31 | 26 | 9 | B |
| (12) | 5.9 | 0.96 | 0.9 | 53 | 36 | 22 | 31 | 14 | C |
| (13) | 6.3 | 0.96 | 0.3 | 52 | 58 | 30 | 22 | 28 | A |
| (14) | 5.6 | 0.96 | 0.3 | 41 | 38 | 29 | 12 | 9 | A |
| (15) | 6.8 | 0.92 | 5.0 | 52 | 48 | 48 | 4 | 0 | A |
| (16) | 6.1 | 0.96 | 0.6 | 51 | 58 | 15 | 36 | 43 | D |

TABLE 2

| | Toner with external additive | Fixing temperature (° C.) | Temperature at which offset is caused (° C.) | Image maintainability | Toner chargeability (μC/g) Commencement | After 100,000 printing | Anti-filming property |
|---|---|---|---|---|---|---|---|
| Example 1 | (1) | 135 | >200 | B | 35 | 31 | A |
| Example 2 | (2) | 125 | >200 | B | 41 | 35 | B |
| Example 3 | (3) | 130 | 200 | B | 33 | 27 | A |
| Example 4 | (4) | 120 | >200 | B | 46 | 38 | B |
| Example 5 | (5) | 120 | >200 | B | 56 | 47 | B |
| Example 6 | (6) | 130 | >200 | B | 44 | 35 | A |
| Example 7 | (7) | 130 | >200 | B | 45 | 35 | A |
| Example 8 | (8) | 135 | >200 | A | 45 | 40 | A |
| Example 9 | (9) | 130 | 190 | B | 38 | 30 | A |
| Example 10 | (10) | 135 | 180 | B | 30 | 27 | A |
| Example 11 | (11) | 120 | 170 | B | 60 | 51 | B |
| Example 12 | (12) | 115 | >200 | C | 48 | 40 | B |
| Example 13 | (13) | 120 | >200 | A | 44 | 38 | B |
| Example 14 | (14) | 130 | >200 | B | 40 | 36 | B |
| Comp. Example 1 | (15) | 145 | 175 | A | 41 | 33 | A |
| Comp. Example 2 | (16) | 115 | 140 | A | 30 | 14 | D |

As shown in Tables 1 and 2, excellent low-temperature fixability, off set resistance and image maintainability can be obtained and, further, charge retentivity and anti-blocking property, which are necessary characteristics before fixation, can be achieved by employing the toners of Examples.

All publications, patent applications, and technical standards mentioned in this specification are herein incorporated by reference to the same extent as if each individual publication, patent application, or technical standard was specifically and individually indicated to be incorporated by reference.

What is claimed is:

1. A toner having:

a fixation temperature of from 100° C. to 135° C.;

a peak temperature before fixation T1*a* of about 40° C. or more; and a peak temperature after fixation T1*b* that is lower than T1*a* by from about 10° C. to about 35° C.:

T1*a* being a peak temperature of an endothermic peak occurring at the lowest temperature in a range of from 0° C. to 100° C. and obtained at a first warming-up step of a differential scanning calorimetry measurement that uses a toner before fixation as a sample; and T1*b* being a peak temperature of an endothermic peak occurring at the lowest temperature within a range of from 0° C. to 100° C. and obtained at a first warming-up step of a differential scanning calorimetry measurement that uses a toner after fixation as a sample; and the toner comprising a binder resin comprising a crystalline polyester resin and a non-crystalline polyester resin or comprising two kinds of polymers polymerized from a monomer mixture comprising styrene and n-butyl acrylate.

2. The toner according to claim 1, wherein T1*b* is lower than T1*a* by from about 20° C. to about 30° C.

3. The toner according to claim 1, wherein T1*b* is lower than a peak temperature T2*a* by from about 1° C. to about 25° C., T2*a* being a peak temperature of an endothermic peak occurring at the lowest temperature within a range of from 0° C. to 100° C. obtained at a second warming-up step of the differential scanning calorimetry measurement that uses the toner before fixation as a sample.

4. The toner according to claim 1, wherein the toner before fixation comprises a crystalline polyester resin.

5. The toner according to claim 4, wherein an alcohol component of the crystalline polyester resin is an aliphatic diol.

6. The toner according to claim 5, wherein the aliphatic diol has 7 to 14 carbon atoms.

7. The toner according to claim 4, wherein the crystalline polyester resin has a melting temperature of from about 50° C. to about 100° C.

8. The toner according to claim 1, wherein the toner before fixation comprises a releasing agent.

9. The toner according to claim 8, wherein the releasing agent has a melting temperature of from about 50° C. to about 110° C.

10. The toner according to claim 1, wherein inorganic particles having an average primary diameter of from about 1 nm to about 200 nm are externally added to the toner before fixation.

11. The toner according to claim 1, wherein the toner before fixation has a volume average particle diameter of from about 3 μm to about 8 μm.

12. The toner according to claim 1, wherein the toner before fixation has an average circularity of from about 0.93 to 1.00.

13. An electrostatic image developer containing the toner before fixation according to claim 1.

14. The toner according to claim 1, wherein the toner comprises a binder resin that comprises a crystalline polyester resin and a plurality of non-crystalline polyester resins.

15. The toner according to claim 1, wherein the toner is produced by a wet method.

16. The toner according to claim 1, wherein the toner comprises a binder resin comprising a crystalline polyester resin or a crystalline vinyl resin.

* * * * *